US007931312B2

(12) United States Patent
Mochizuki et al.

(10) Patent No.: US 7,931,312 B2
(45) **Date of Patent: *Apr. 26, 2011**

(54) APPARATUS FOR OPENING AND CLOSING DOOR

(75) Inventors: Shintaro Mochizuki, Yamanashi (JP); Masashi Shimizu, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 717 days.

This patent is subject to a terminal disclaimer.

(21) Appl. No.: 11/283,747

(22) Filed: Nov. 22, 2005

(65) Prior Publication Data

US 2006/0125244 A1 Jun. 15, 2006

(30) Foreign Application Priority Data

Nov. 26, 2004 (JP) ..... 2004-342868

(51) Int. Cl.
*E05C 3/06* (2006.01)
*E05C 3/16* (2006.01)

(52) U.S. Cl. ..... 292/216; 292/336.3; 292/DIG. 46

(58) Field of Classification Search ..... 292/216, 292/336.3, DIG. 46
See application file for complete search history.

(56) References Cited

U.S. PATENT DOCUMENTS

| | | | | |
|---|---|---|---|---|
| 3,993,338 | A * | 11/1976 | Cherbourg et al. | 292/336.3 |
| 3,993,339 | A * | 11/1976 | Cherbourg et al. | 292/336.3 |
| 5,234,237 | A * | 8/1993 | Gergoe et al. | 292/201 |
| 5,893,593 | A * | 4/1999 | Dowling | 292/336.3 |
| 6,032,987 | A | 3/2000 | Fukumoto et al. | |
| 6,135,513 | A | 10/2000 | Hamada et al. | |
| 6,158,788 | A | 12/2000 | Ikeda et al. | |
| 6,561,557 | B2 * | 5/2003 | Choi | 292/336.3 |
| 6,616,202 | B2 * | 9/2003 | Choi | 292/336.3 |
| 6,651,387 | B2 | 11/2003 | Choi | |
| 6,722,714 | B2 * | 4/2004 | Ooe et al. | 292/216 |
| 7,341,291 | B2 * | 3/2008 | Ooe et al. | 292/336.3 |
| 7,438,331 | B2 * | 10/2008 | Wakatsuki | 292/216 |
| 7,591,493 | B2 * | 9/2009 | Nozawa | 292/216 |
| 2004/0262927 | A1 | 12/2004 | Fukunaga et al. | |
| 2005/0099022 | A1 * | 5/2005 | Wakatsuki | 292/336.3 |
| 2006/0049643 | A1 | 3/2006 | Roussel | |
| 2007/0138813 | A1 | 6/2007 | Park | |
| 2007/0284892 | A1 * | 12/2007 | Nozawa | 292/216 |

FOREIGN PATENT DOCUMENTS

| | | | |
|---|---|---|---|
| DE | 601 07 921 | T2 | 12/2005 |
| JP | 7-293083 | A | 11/1995 |
| JP | 8-240049 | A | 9/1996 |
| JP | 10-317756 | A | 12/1998 |
| JP | 2001-182402 | A | 7/2001 |
| JP | 2001-182403 | A | 7/2001 |
| JP | 2002-147095 | A | 5/2002 |
| KR | 10-2004-0070062 | A | 8/2004 |
| KR | 10-0452806 | B1 | 10/2004 |

* cited by examiner

*Primary Examiner* — Carlos Lugo
(74) *Attorney, Agent, or Firm* — Foley & Lardner LLP

(57) ABSTRACT

A door-operating lever is disposed on a base plate of a control unit. A door-operating knob includes an operation output portion that engages with a door-operating lever. When the door-operating knob is operated to open or close a door of a vehicle, the operation output portion engages with the door-operating lever in such a manner that the door-operating lever is rotated in a desired direction to cause a closed-door holding unit or an opened-door holding unit to release the door.

5 Claims, 22 Drawing Sheets

APPARATUS FOR OPENING AND CLOSING DOOR

BACKGROUND OF THE INVENTION

1. Field of the Invention

The present invention relates to an apparatus for opening and closing a door of a vehicle.

2. Description of the Related Art

A vehicle having a slide door is usually provided with a closed-door holding unit and an opened-door holding unit between a body of the vehicle and the slide door. The closed-door holding unit holds the slide door in a closed state with respect to the body of the vehicle, while the opened-door holding unit holds the slide door in an opened state.

An apparatus for opening and closing the door (hereinafter "a door operating apparatus") employed in such a vehicle is generally provided with a door opening lever that is rotated according to a door opening operation of an inside knob to make the closed-door holding unit release the door, and a door closing lever that is rotated according to a door closing operation of the inside knob to make the opened-door holding unit release the door. That is, when the inside knob is operated to open the door in a closed state, the closed-door holding unit is actuated release the door according to a rotational operation of the door opening lever, so that the slide door can be moved to be opened. On the other hand, when the inside knob is operated to close the door in an opened state, the opened-door holding unit is actuated to release the door according to a rotational operation of the door closing lever, so that the slide door can be moved to be closed. A conventional technology has been disclosed, for example, in Japanese Patent Application Laid-Open No. 2001-182402.

In the conventional door operating apparatus, since the inside knob, the door opening lever, and the door closing lever are constituted as one integral unit, these members are not required to be handled individually when assembling to a vehicle, which makes a mounding work easy. However, since link rods and wire cables for transmitting power must be provided between the inside knob, the door opening lever, and the door closing lever, an assembling of the door operating apparatus becomes complicated.

SUMMARY OF THE INVENTION

It is an object of the present invention to at least solve the problems in the conventional technology.

An apparatus for opening and closing a door of a vehicle, according to one aspect of the present invention, includes a door-operating knob that is operated to open or close the door; a closed-door holding unit configured to hold the door in a closed state, and to release the door in response to an opening operation of the door-operating knob to allow an opening of the door with respect to a body of the vehicle; an opened-door holding unit configured to hold the door in an opened state, and to release the door in response to a closing operation of the door-operating knob to allow a closing of the door with respect to the body of the vehicle; and a control unit that controls operations of the closed-door holding unit and the opened-door holding unit, including a base plate, and a door-operating lever configured to cause the closed-door holding unit to release the door by rotating in one direction, and to cause the opened-door holding unit to release the door by rotating in other direction. The door-operating lever-is disposed on the base plate. The door-operating knob includes an operation output portion that engages with the door-operating lever. When the door-operating knob is operated to open or close the door, the operation output portion makes a contact with the door-operating lever to be engaged in such a manner that the door-operating lever is rotated in either of the directions.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings.

Figure 1:
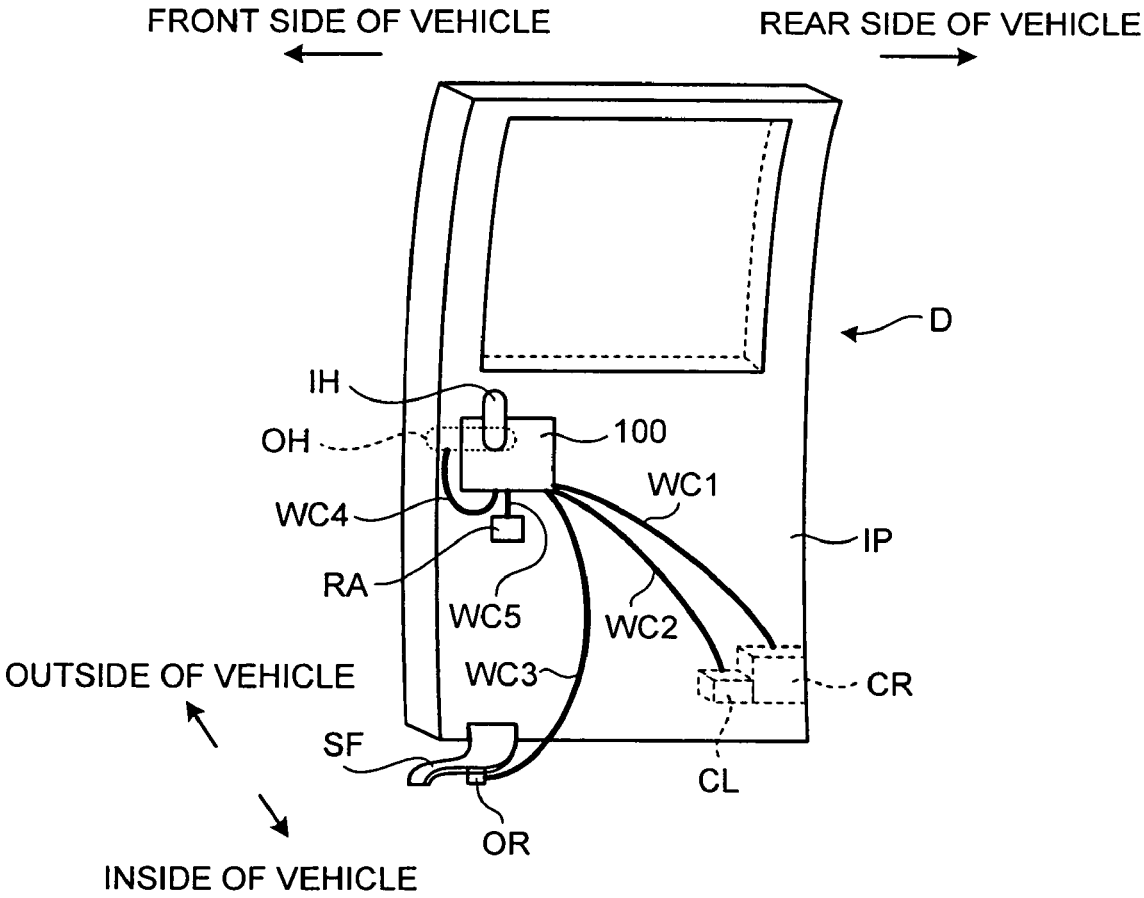
FIG. 1 is a perspective view of a slide door including a door operating apparatus according to an embodiment of the present invention.
Figure 2:
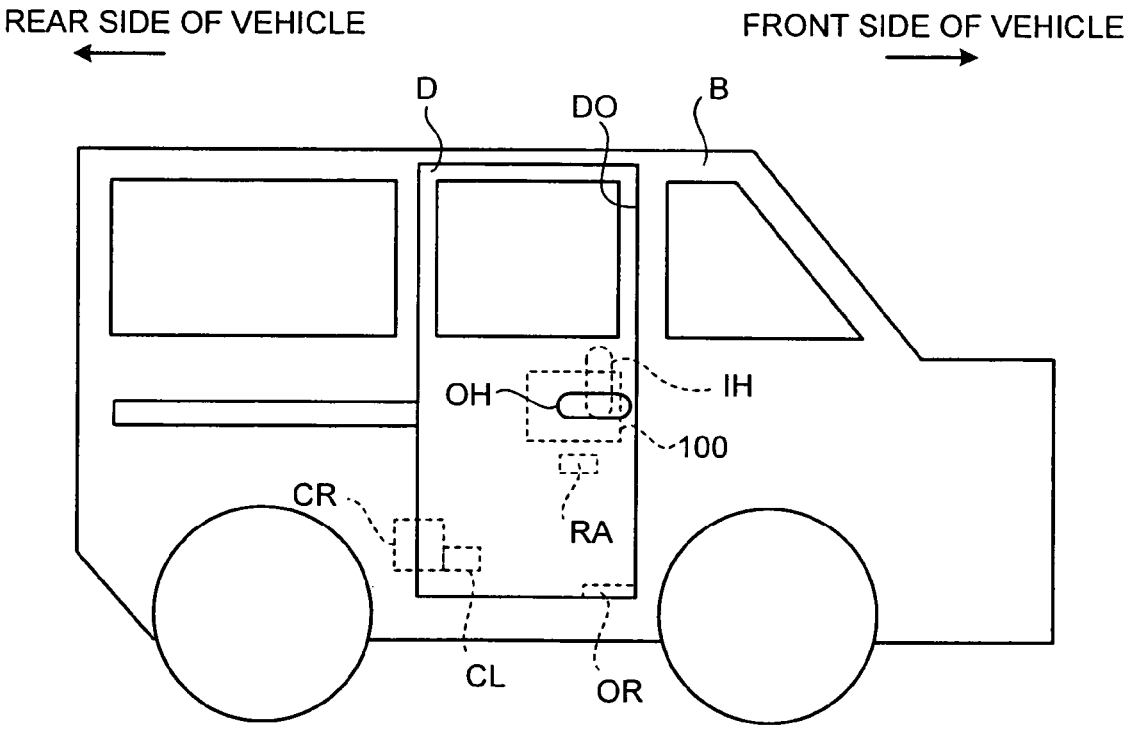
FIG. 2 is a side view of a vehicle provided with the slide door shown in FIG. 1.
Figure 3:
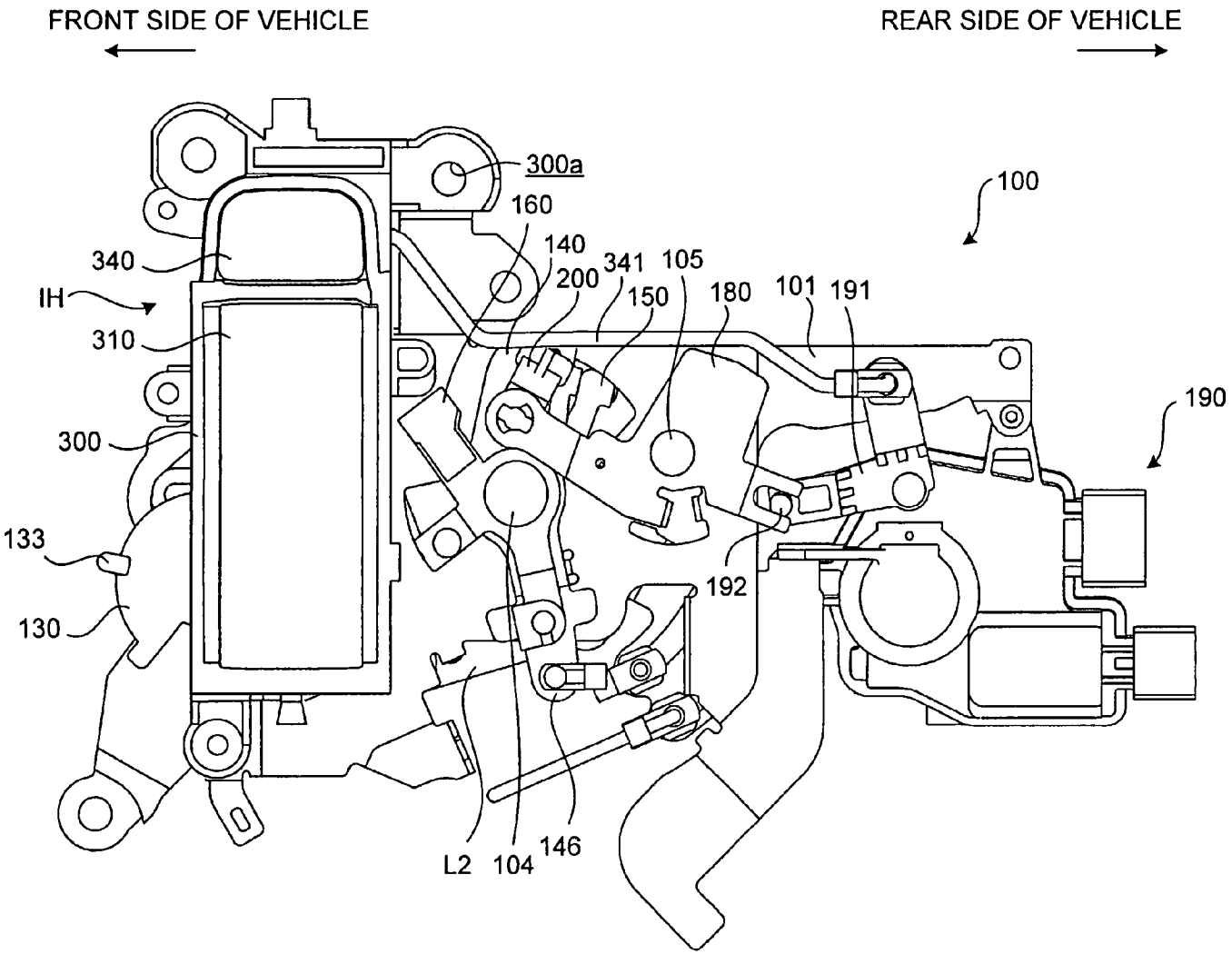
FIG. 3 is a schematic of a control unit of the door operating apparatus shown in FIG. 1, viewed from an inside of the vehicle.

FIG. 1 is a perspective view of a slide door including a door operating apparatus according to an embodiment of the present invention. The door operating apparatus includes a control unit 100 that, when an inside knob IH or an outside knob OH is operated, controls the operation of a closed-door latch unit CR or an opened door latch unit OR provided between a vehicle body B and a slide door D in a vehicle as shown in FIG. 2.

The slide door D to be applied with the door operating apparatus is used for opening and closing a door opening DO by sliding the door D in front and rear directions along a side of the vehicle body B. A door operating apparatus provided for a slide door D arranged on a right side of the vehicle body B (a door arranged on a rear side of a driver seat in a right-hand-drive vehicle) will be explained as an example. A door operating apparatus for a slide door arranged on a left side of the vehicle body B may have a reverse configuration.

A closed-door latch unit CR constitutes a closed-door holding unit that holds the slide door D in a closed state to the vehicle body B, and is provided between a rear edge of the slide door D and the vehicle body B. Though not shown, the closed-door latch unit CR described herein includes a closure device CL. The closure device CL is an actuator with a clutch mechanism (not shown) housed therein, and functions to make the closed-door latch unit CR shift to a full latch state under a condition that the clutch mechanism is in a connected state when the closed-door latch unit CR is in a half latch state. The closed-door latch unit CR is constituted so as to interrupt the shift operation immediately when the clutch mechanism becomes a disconnected state even if the closed-door latch unit CR is in the middle of shifting from the half latch state to the full latch state.

The opened door latch unit OR constitutes an opened-door holding unit that holds the slide door D in an opened state to the vehicle body B, and is provided between a support frame SF provided on the slide door D and the vehicle body B. The support frame SF serves as a guide when the slide door D is slid along the vehicle body B, and is provided to be project from a front lower end of a door inner panel IP toward a inside of the vehicle.

The closed-door latch unit CR and the opened door latch unit OR have configurations similar to conventional ones, and each thereof is provided with, for example, a latch engaged with a striker provided on the vehicle body B and a ratchet that controls movement of the latch.

FIGS. 3 to 14 are schematics of the control unit 100 according to the embodiment. The control unit 100 exemplified herein is attached to an outer surface upper portion of an inside of the vehicle in the door inner panel IP of the slide door D via a base plate 101. The base plate 101 is provided with an inside-knob lever shaft 102. The inside-knob lever shaft 102 is provided with a door-operating lever 110 and a link lever 120. A child lock lever 130 is provided at a portion of the base plate 101 positioned near to the inside-knob lever shaft 102.

The door-operating lever 110 is disposed at a proximal portion of the inside-knob lever shaft 102 so as to rotate about the inside-knob lever shaft 102 on a back side (a outside of the vehicle) of the base plate 101, and it is provided about a disk-shaped operation lever base 111 with a link engagement portion 112, an inside-knob engagement portion 113, a first link slide connector 114, and a first spring engagement portion 115.

The link engagement portion 112 extends from a portion of the operation lever base 111 positioned on a front side of the vehicle toward the front side of the vehicle.

The inside-knob engagement portion 113 extends substantially downward from a lower side portion of the operation lever base 111 to be formed with an extended end widened toward a rear side of the vehicle. The inside-knob engagement portion 113 has a length sufficiently longer than the link engagement portion 112, and has a door-opening-operation detector 116 on a side edge positioned on the front side of the vehicle and has an output-portion engagement hole 117 and a door-closing-operation detector 118 on the widened extended end.

Figure 4:
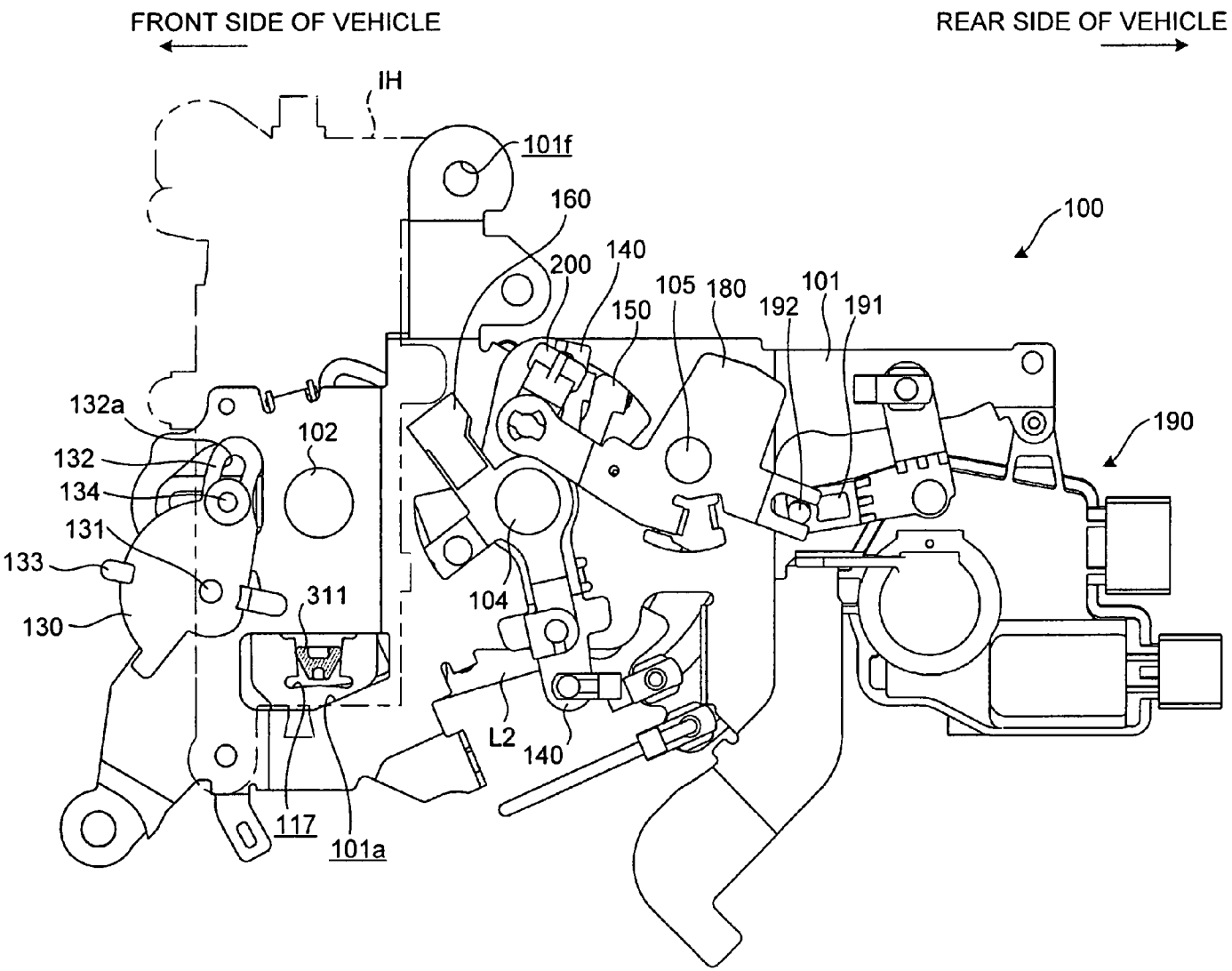
FIG. 4 is a schematic of a detailed configuration of the control unit shown in FIG. 3, viewed from the inside of the vehicle.
Figure 5:
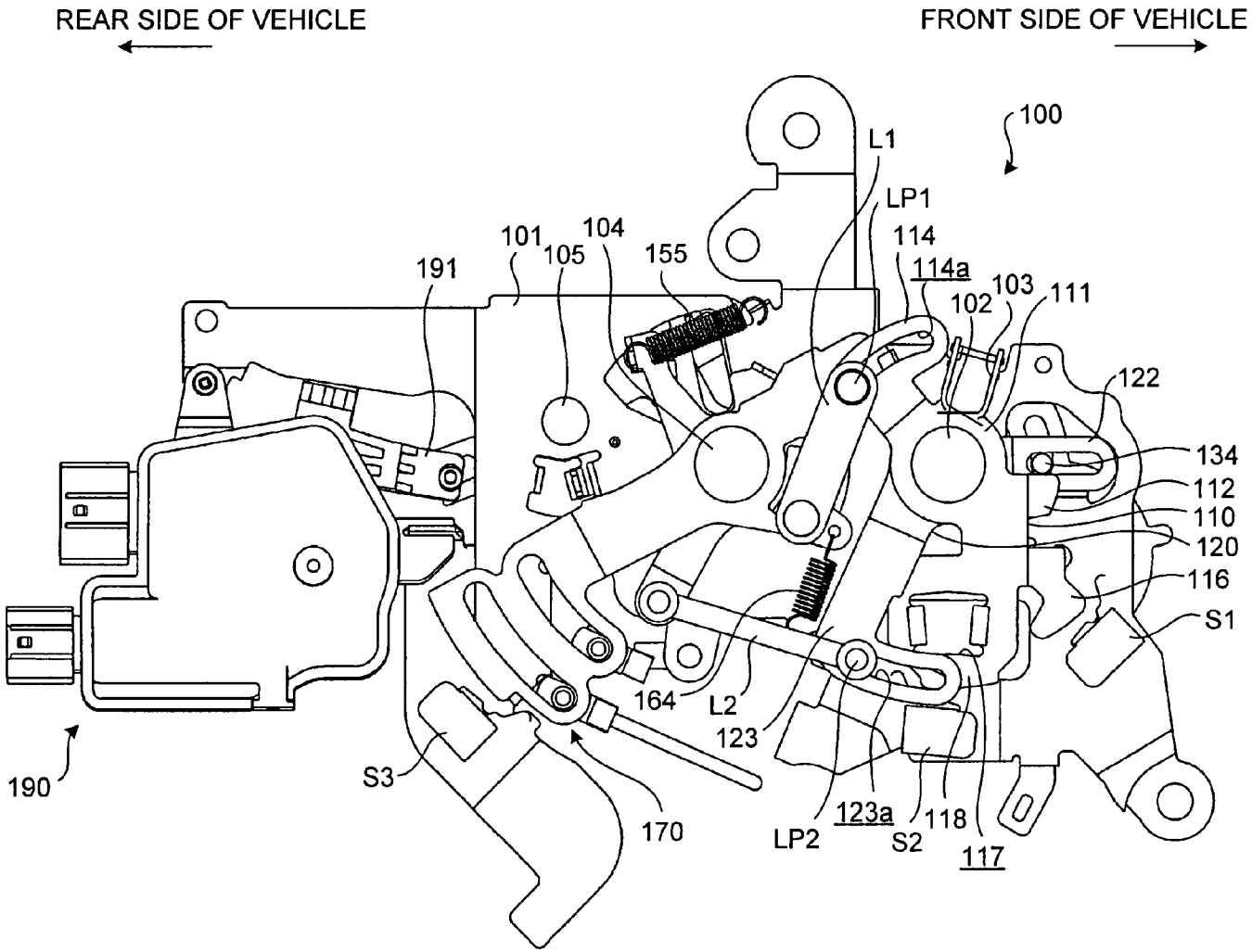
FIG. 5 is a schematic of a detailed configuration of the control unit shown in FIG. 3, which is viewed from an outside of the vehicle.
Figure 6:
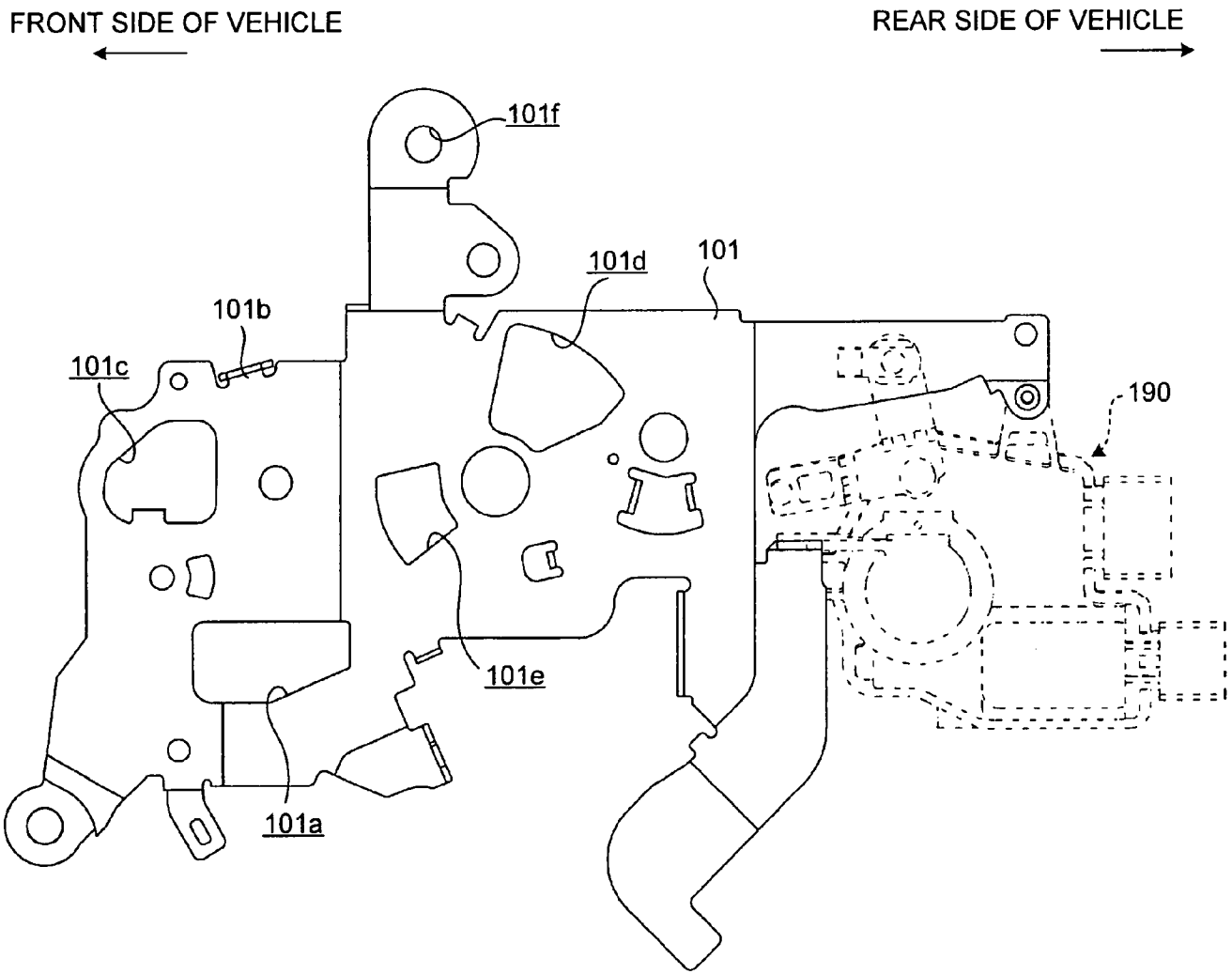
FIG. 6 is a schematic of a base plate applied to the control unit shown in FIG. 3, viewed from the inside of the vehicle.
Figure 7:
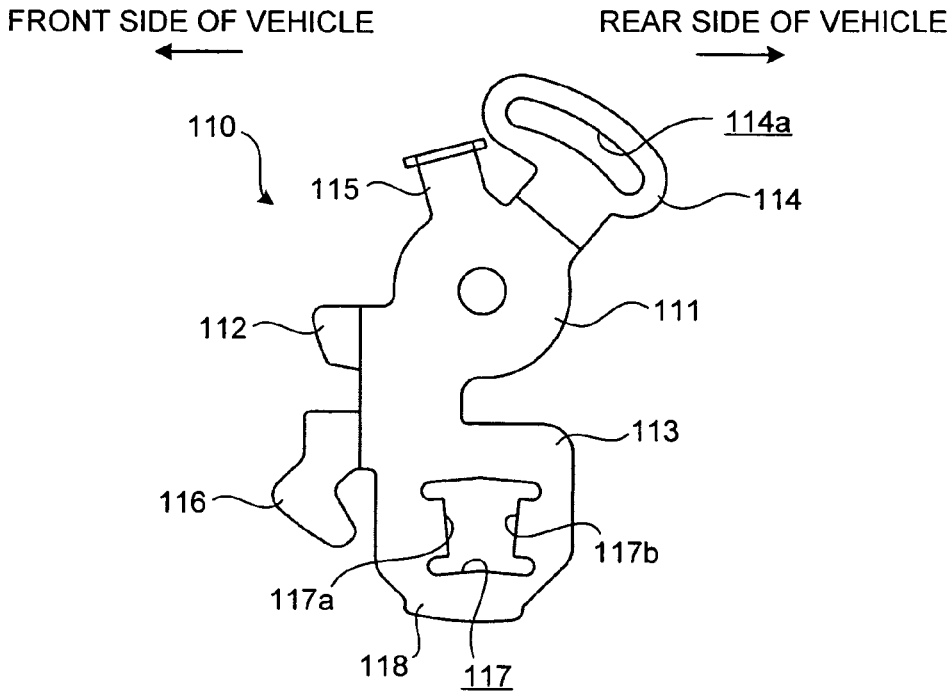
FIG. 7 is a schematic of a door-operating lever applied to the control unit shown in FIG. 3, viewed from the inside of the vehicle.
Figure 8:
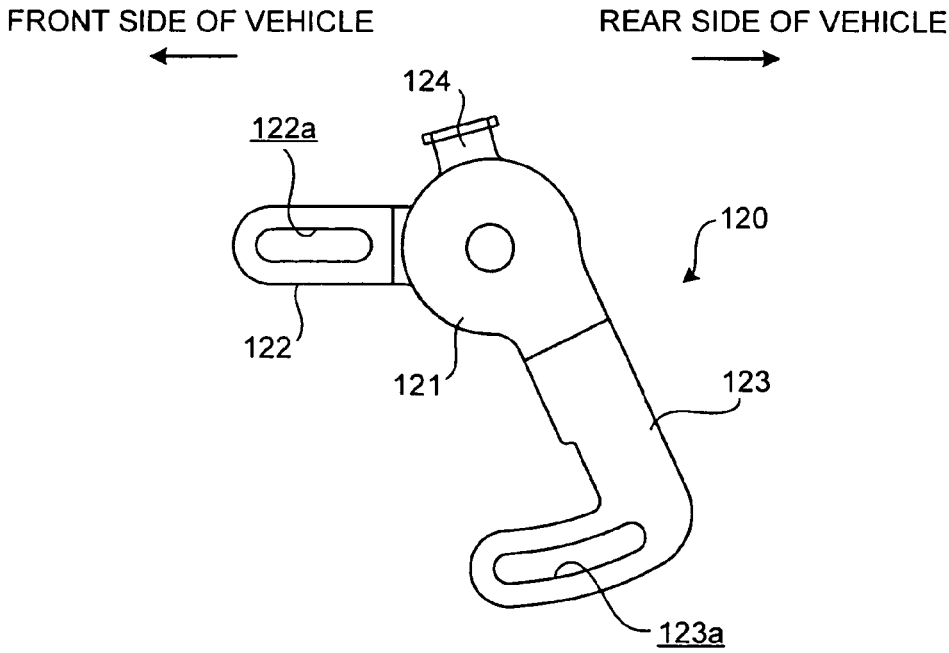
FIG. 8 is a schematic of a link lever applied to the control unit shown in FIG. 3, viewed from the inside of the vehicle.
Figure 9:
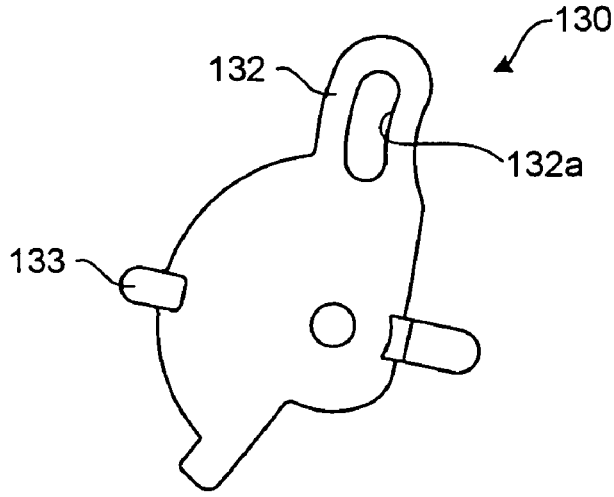
FIG. 9 is a schematic of a child lock lever applied to the control unit shown in FIG. 3, viewed from the inside of the vehicle.
Figure 10:
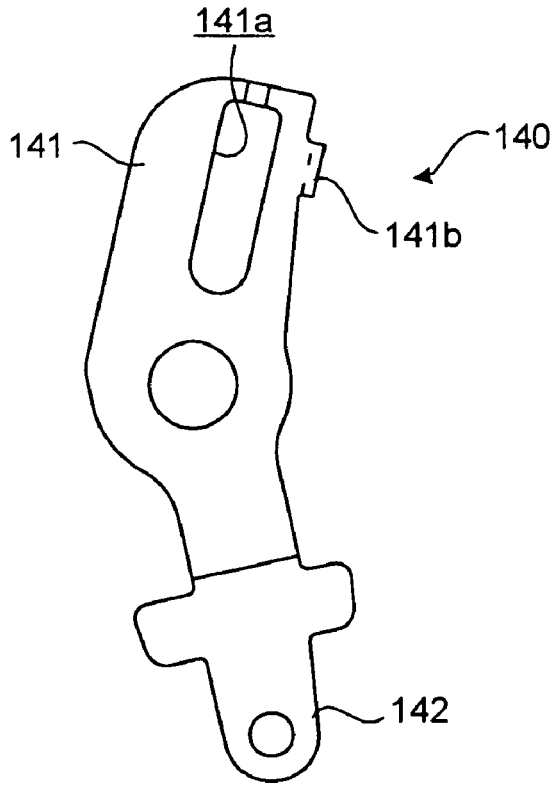
FIG. 10 is a schematic of an open lever applied to the control unit shown in FIG. 3, viewed from the inside of the vehicle.
Figure 11:
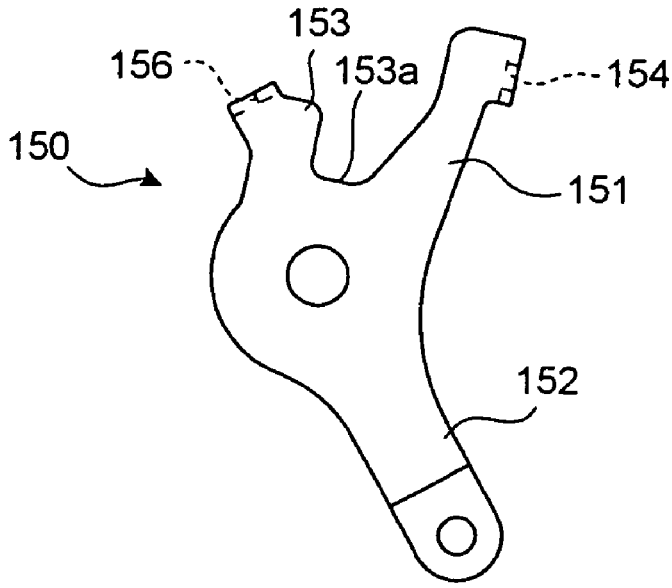
FIG. 11 is a schematic of an open sub-lever applied to the control unit shown in FIG. 3, viewed from the inside of the vehicle.
Figure 12:
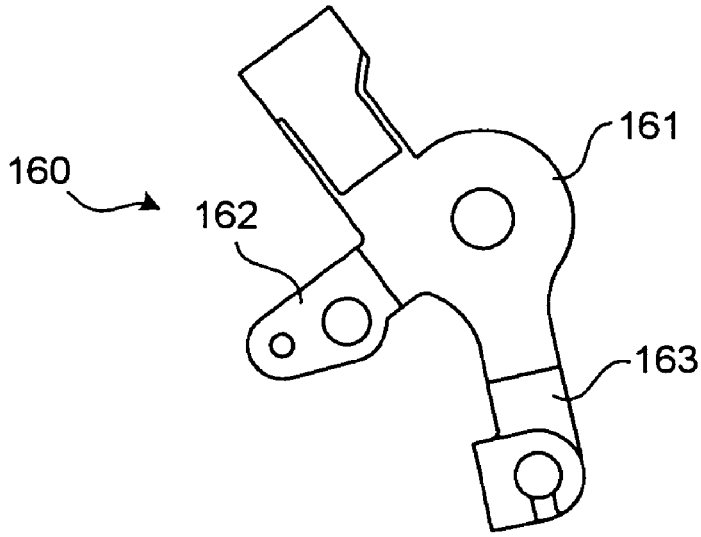
FIG. 12 is a schematic of a lower open lever applied to the control unit shown in FIG. 3, viewed from the inside of the vehicle.
Figure 13:
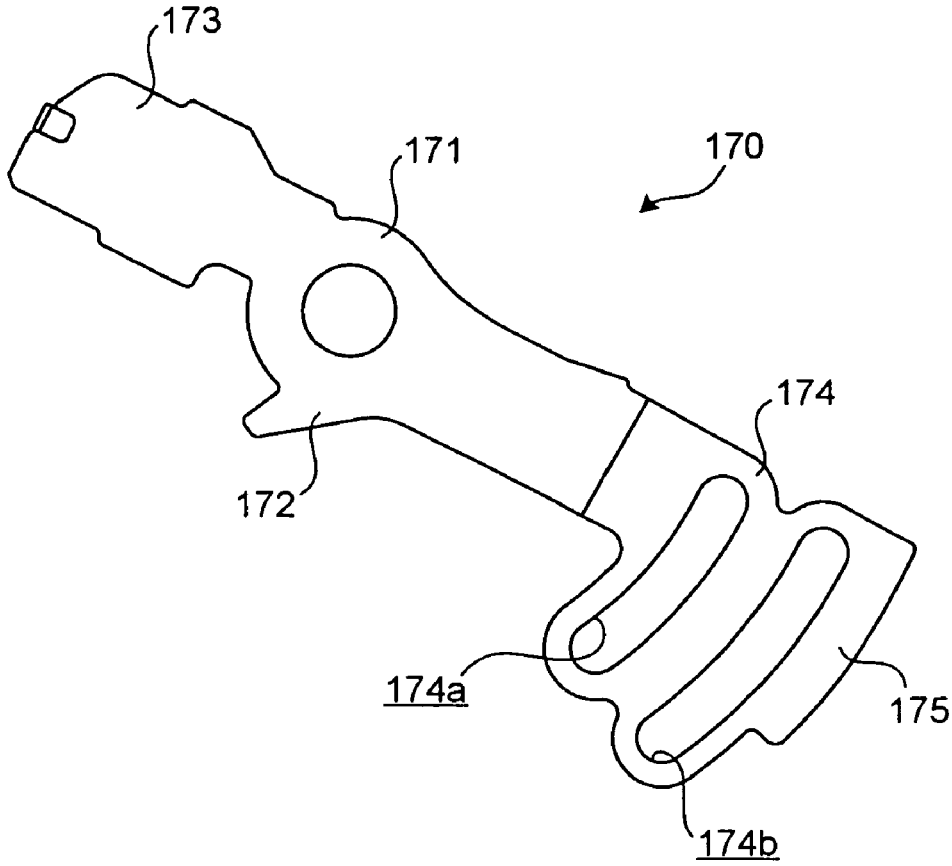
FIG. 13 is a schematic of an open knob lever applied to the control unit shown in FIG. 3, viewed from the inside of the vehicle.
Figure 14:
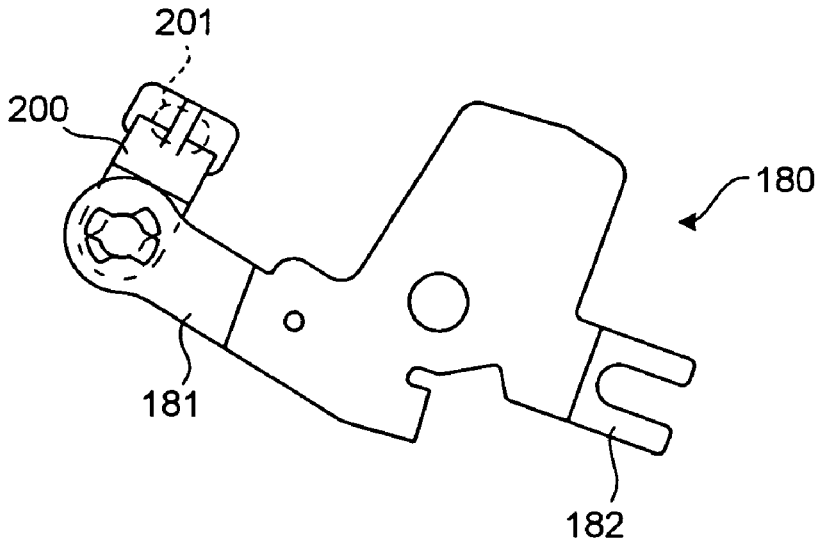
FIG. 14 is a schematic of a locking lever applied to the control unit shown in FIG. 3, viewed from the inside of the vehicle.

The door-opening-operation detector 116 extends obliquely downward toward the front side of the vehicle and further extends obliquely downward toward the rear side of the vehicle. The door-opening-operation detector 116 is spaced from a first door-operation detecting sensor S1 provided on the base plate 101 when the inside-knob engagement portion 113 is put in a downwardly extending state, while it abuts on the first door-operation detecting sensor S1 to turn ON the sensor when the door-operating lever 110 rotates counterclockwise in FIG. 5. The output-portion engagement hole 117 is formed on the extended end of the inside-knob engagement portion 113 so as to have a front-side abutting face 117*a* at a portion positioned on the front side of the vehicle and a rear-side abutting face 117*b* at a portion positioned on the rear side of the vehicle. As shown in FIG. 4, a portion of the inside-knob engagement portion 113 formed with the output-portion engagement hole 117 is exposed to a surface side of the base plate 101 via an insertion window hole 101*a* formed in the base plate 101. The door-closing-operation detector 118 projects from a distal end of the inside-knob engagement portion 113. The door-closing-operation detector 118 is spaced from a second door-operation detecting sensor S2 provided on the base plate 101 when the inside-knob engagement portion 113 is put in a downwardly extending state, while it abuts on the second door-operation detecting sensor S2 to turn ON the sensor, when the door-operating lever 110 rotates clockwise in FIG. 5.

The first link slide connector 114 extends from an upper portion of the operation lever base 111 toward the rear side of the vehicle obliquely upwardly, and it has a first slide groove hole 114*a* on its extended end. The first slide groove hole 114*a* is a narrow notch formed in an arc shape about the inside-knob lever shaft 102. The first link slide connector 114 is coupled with one end of a first coupling link L1 in a state that a coupling pin LP1 is inserted in the first slide groove hole 114*a*.

The first spring engagement portion 115 extends upwardly from an upper portion of the operation lever base 111. The first spring engagement portion 115 is engaged with a return coil spring 103 connected to a spring engagement base 101*b* provided on the base plate 101. The return coil spring 103 is used for holding the door-operating lever 110 in a home position where the inside-knob engagement portion 113 extends downwardly.

The link lever 120 is disposed between the base plate 101 and the door-operating lever 110 so as to be rotatable about the inside-knob lever shaft 102, and has a pin slide portion 122, a second link sidle connector 123, and a second spring engagement portion 124 about a link lever base 121 formed in a disk shape.

The pin slide portion 122 extends from a front side of the vehicle of the link lever base 121 in the vehicle front direction and has a length longer than the link engagement portion 112 of the door-operating lever 110. The pin slide portion 122 is provided with a pin slide groove 122*a* extending in a radial direction from the axial center of the inside-knob lever shaft 102.

The second link slide connector 123 extends downward from a lower portion of the link lever base 121 toward the rear side of the vehicle and further extends toward the front side of the vehicle in a bending manner, and has a second slide groove hole 123*a* at a portion thereof extending toward the front side of the vehicle. The second slide groove hole 123*a* is a narrow notch formed in an arc shape about the inside-knob lever shaft 102 like the first slide groove hole 114*a*. The second link slide connector 123 is coupled to one end of a second coupling link L2 in a state that a coupling pin LP2 is inserted in the second slide groove hole 123*a*.

The second spring engagement portion 124 extends from an upper portion of the link lever base 121 upwardly along the first spring engagement portion 115 of the door-operating lever 110 when the pin slide portion 122 extends along the link engagement portion 112 of the door-operating lever 110. The second spring engagement portion 124 is engaged with the return coil spring 103 engaged with the first spring engagement portion 115 of the door-operating lever 110. The return coil spring 103 has a function of holding the link lever 120 in a home position where the pin slide portion 122 extends along the link engagement portion 112 of the door-operating lever 110.

The child lock lever 130 is rotatably disposed on a surface side of the base plate 101 at a portion thereof positioned on the front side of the vehicle of the inside-knob lever shaft 102 via a child lock lever shaft 131, and includes a pin acting portion 132 and a switching operation portion 133.

The pin acting portion 132 extends from the child lock lever shaft 131 in a direction of crossing the pin slide portion 122 of the link lever 120, and it has a pin acting groove 132*a*. The pin acting groove 132*a* extends along a longitudinal direction of the pin acting portion 132 and it has an engagement pin 134 disposed therein. The engagement pin 134 is disposed slidably along a longitudinal direction of the pin acting groove 132*a*, and an end thereof positioned on the outside of the vehicle projects toward a back side through a pin insertion opening 101*c* of the base plate 101 to engage with the pin slide groove 122*a* of the link lever 120.

The switching operation portion 133 is used for switching the child lock lever 130 between an unlock position and a lock position and extends from the child lock lever shaft 131 toward the front side of the vehicle so as to project from a frond edge of the base plate 101. The child lock lever 130 has a function of causing the engagement pin 134 in the pin slide portion 122 of the link lever 120 to be positioned in a rotational movement region of the link engagement portion 112 of the door-operating lever 110 when the child lock lever 130 is in the unlock position. The child lock lever 130 also has a function of causing the engagement pin 134 in the pin slide portion 122 of the link lever 120 to be positioned out of the rotational movement region of the link engagement portion 112 of the door-operating lever 110 when it is in the lock position.

The control unit 100 supports an open lever 140, an open sub-lever 150, a lower open lever 160, and an open knob lever 170 at a portion of the base plate 101 positioned on the rear side of the vehicle from the inside-knob lever shaft 102, via a lever shaft 104. The control unit 100 also supports, via a lock lever shaft 105, a locking lever 180 at a portion of the base plate 101 positioned on the rear side of the vehicle from the lever shaft 104. The open lever 140, the open sub-lever 150, the lower open lever 160, and the open knob lever 170 are disposed on the base plate 101 via a common lever shaft 104, but they may be disposed about the lever shaft 104 individually.

The open lever 140 is disposed on the surface side of the base plate 101, and has a sub-lever engagement portion 141 and a wire cable connector 142.

The sub-lever engagement portion 141 extends from the lever shaft 104 upwardly, and has a lock-pin slide groove 141*a* and an engagement projection 141*b*. The lock-pin side groove 141*a* is a linear groove formed along an extension direction of the sub-lever engagement portion 141. The engagement projection 141*b* extends from an edge of the sub-lever engagement portion 141 extending along the rear side of the vehicle toward the base plate 101 in a bending manner, and projects to the back side of the base plate 101 via a lever through-hole 101*d* provided in the base plate 101.

The wire cable connector 142 extends from the lever shaft 104 downwardly slightly toward the rear side of the vehicle. The wire cable connector 142 is coupled with one end of a first wire cable WC1 and one end of a second wire cable WC2. The first wire cable WC1 is linked at the other end thereof to the closed-door latch unit CR, and it makes the closed-door latch unit CR perform releasing operation when the first wire cable WC1 is pulled. The second wire cable WC2 is linked at the other end thereof to the closure device CL of the closed-door latch unit CR, and it switches the clutch mechanism of the closure device CL switching from a connected state to a disconnected state when the second wire cable WC2 is pulled.

The open sub-lever 150 is disposed on the back side of the base plate 101, and has an open-lever engagement portion 151, a second link connector 152, and a lock-pin engagement portion 153.

The open-lever engagement portion 151 extends upwardly from the lever shaft 104 and engages with the engagement projection 141*b* of the open lever 140 via a side of the front side of the vehicle in an abutting manner. The open-lever engagement portion 151 is coupled with one end of a first coil spring 155 via a coil spring coupling portion 154. The first coil spring 155 is interposed between the open-lever engagement portion 151 and the base plate 101, and always biases the open sub-lever 150 in a clockwise direction in FIG. 5.

The second link connector 152 extends downwardly from the lever shaft 104 and is coupled with the other end of the second coupling link L2.

The lock-pin engagement portion 153 extends along the sub-lever engagement portion 141 while an engagement recess 153*a* coincident with the lock-pin slide groove 141*a* is secured between the open-lever engagement portion 151 and the lock-pin engagement portion 153 when the open-lever engagement portion 151 engages with the sub-lever engagement portion 141 of the open lever 140 via the engagement projection 141*b*. The lock-pin engagement portion 153 is sufficiently shorter than the lock-pin slide groove 141*a* of the open lever 140. The lock-pin engagement portion 153 is provided with a knob-lever engagement portion 156. The knob-lever engagement portion 156 bends from an extended end of the lock-pin engagement portion 153 toward the outside of the vehicle.

The lower open lever 160 is disposed at a inside of the vehicle of the open lever 140 on the surface side of the base plate 101, and has a first link connector 162 and a third wire cable connector 163 about a disk-shaped lower open lever base 161.

The first link connector 162 extends from a front side of the vehicle portion of the lower open lever base 161 toward the outside of the vehicle to pass through a lower open insertion hole 101*e* of the base plate 101 to a back side of the base plate 101 and further extends on the back side of the base plate 101 slightly obliquely downward toward the front side of the vehicle. A portion of the first link connector 162 positioned on the back side of the base plate 101 is coupled with the other end of the first coupling link L1 and a portion thereof positioned at a distal end side from the first coupling link L1 is connected with a second coil spring 164. The second coil spring 164 is interposed between the lower open lever 160 and the base plate 101 and always biases the lower open lever 160 clockwise in FIG. 5.

The third wire cable connector 163 extends from the lever shaft 104 along the wire cable connector 142 of the open lever 140. The third wire cable connector 163 is coupled with one end of a third wire cable WC3. The third wire cable WC3 is linked to the opened door latch unit OR at the other end thereof, and makes the opened door latch unit OR perform releasing operation when the third wire cable WC3 is pulled.

The open knob lever 170 is disposed at a vehicle outermost portion of the lever shaft 104 on the back side of the base plate 101, and has a first lever engagement portion 172, a second lever engagement portion 173, a wire-cable slide connector 174, and a third door operation detector 175 about a disk-shape knob lever base 171.

The first lever engagement portion 172 extends from a lower peripheral portion of the knob lever base 171 toward the front side of the vehicle and abuts on a lower side of the first link connector 162 of the lower open lever 160.

The second lever engagement portion 173 extends obliquely upward from an upper portion of the knob leer base 171 toward the front side of the vehicle and abuts on an end face of the knob-lever engagement portion 156 of the open sub-lever 150 positioned at the front side of the vehicle, through a side facing upward side thereof.

The wire-cable slide connector 174 extends downwardly from a lower portion of the knob lever base 171 toward the rear side of the vehicle. The wire-cable slide connector 174 is coupled with one end of a fourth wire cable WC4 and one end of a fifth wire cable WC5 through wire-connection groove holes 174*a* and 174*b* such that these cables WC4 and WC5 can slide. The wire-connection groove holes 174*a* and 174*b* are narrow notches formed in an arc shape about the lever shaft 104, respectively. The fourth wire cable WC4 has the other end linked to the outside knob OH, and functions to rotate the open knob lever 170 counterclockwise in FIG. 5 when the outside knob OH is operated. The fifth wire cable WC5 has the other end linked to an output lever (not shown) of a release actuator RA. Though not shown, in the release actuator RA, the output lever is positioned in a rear side of the vehicle in a normal state. In this state, no tension is applied to the fifth wire cable WC5 coupled to the open knob lever 170. For example, when the first door-operation detecting sensor S1 or the second door-operation detecting sensor S2 turns ON from this state, the release actuator RA is driven utilizing an ON state of the door-operation detecting sensor S1 or S2 as a trigger to cause swinging of the output lever toward the vehicle front direction, thereby swinging the open knob lever 170 counterclockwise in FIG. 5 via the fifth wire cable WC5.

The third door operation detector 175 projects from a distal end of the wire-cable slide connector 174. The third door operation detector 175 is spaced from a third door-operation detecting sensor S3 provided on the base plate 101 when the wire-cable slide connector 174 is positioned to extend from the knob lever base 171 toward the rear side of the vehicle downwardly, while it abuts on the third door-operation detecting sensor S3 to turn ON the sensor S3 when the open knob lever 170 is rotated in the counterclockwise direction in FIG. 5.

The locking lever 180 is disposed on the surface side of the base plate 101, and has a lock pin holder 181 and an actuator engagement portion 182.

The lock pin holder 181 extends from the lock lever shaft 105 toward the front side of the vehicle. The lock pin holder 181 is provided at its extension end with a lock member 200. The lock member 200 is rotatably supported by the lock pin holder 181 via a proximal portion thereof, and has a lock pin 201 at a distal end thereof. The lock pin 201 is a cylindrical member projecting from a distal end of the lock member 200 toward the base plate 101. A projecting end of the lock pin 201 passes through a lock-pin slide groove 141*a* of the open lever 140 and further passes through the lever through-hole 101*d* provided in the base plate 101 to be engageable with the engagement recess 153*a* provided between the open-lever engagement portion 151 and the lock-pin engagement portion 153 of the open sub-lever 150.

The actuator engagement portion 182 extends from the lock lever shaft 105 toward the rear side of the vehicle and its distal end is bifurcated, so that the actuator engagement portion 182 is linked to a locking actuator 190 via the bifurcated portion.

The locking actuator 190 is attached to a vehicle rearmost portion of the base plate 101, and is provided at a front side of the vehicle upper portion thereof with a locking output lever 191. The locking output lever 191 is swung up and down along the surface of the base plate 101, and an engagement projection 192 provided at a distal end of the locking output lever 191 is engaged with the bifurcated portion of the actuator engagement portion 182.

The locking actuator 190 functions to move the lock pin holder 181 downwardly via the actuator engagement portion 182 to cause the lock pin 201 in the lock-pin slide groove 141*a* of the open lever 140 to position in a rotational movement region of the lock-pin engagement portion 153, thereby putting the control unit 100 in an unlock state, when the locking output lever 191 is swung to the uppermost position. The locking actuator 190 also functions to move the lock pin holder 181 upwardly via the actuator engagement portion 182 to cause the lock pin 201 in the lock-pin slide groove 141*a* of the open lever 140 to position out of the rotational movement region of the lock-pin engagement portion 153, thereby shifting the control unit 100 in a lock state, when the locking output lever 191 is swung to the lowermost position.

Figure 15:
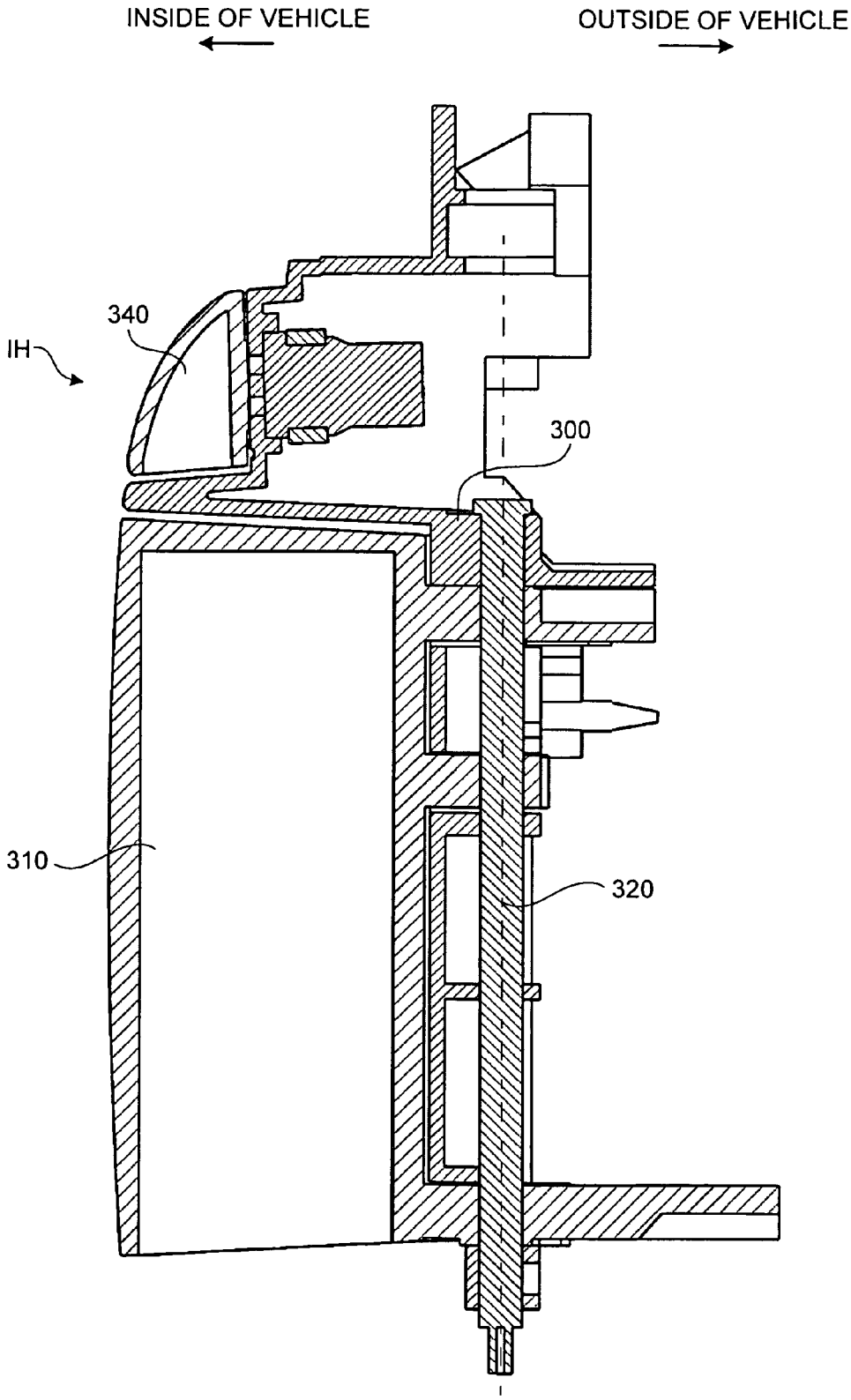
FIG. 15 is side view of a cross section of an inside knob applied to the door operating apparatus shown in FIG. 1.
Figure 16:
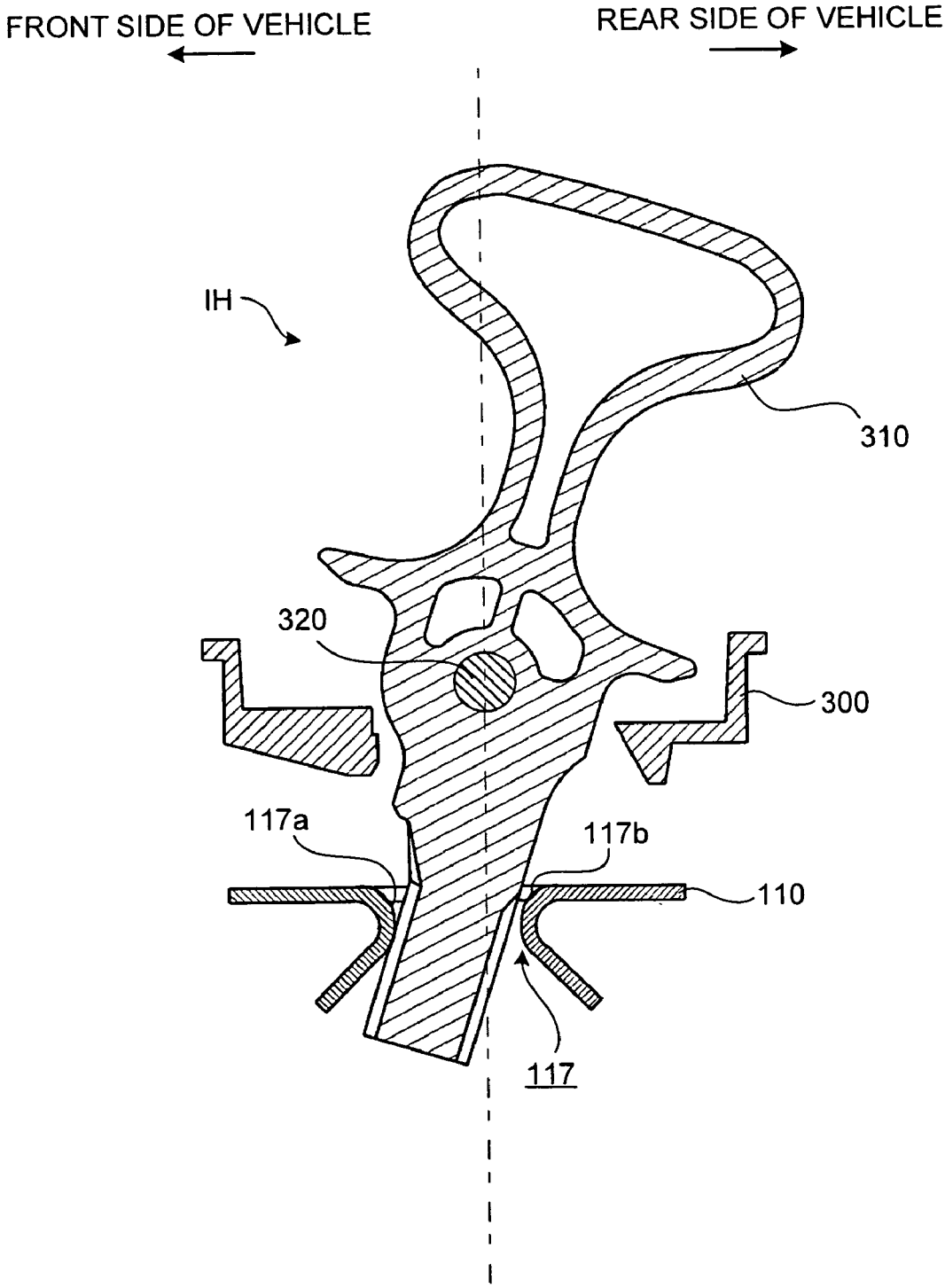
FIG. 16 is a cross section of the inside knob shown in FIG. 15, in a state of opening operation.
Figure 17:
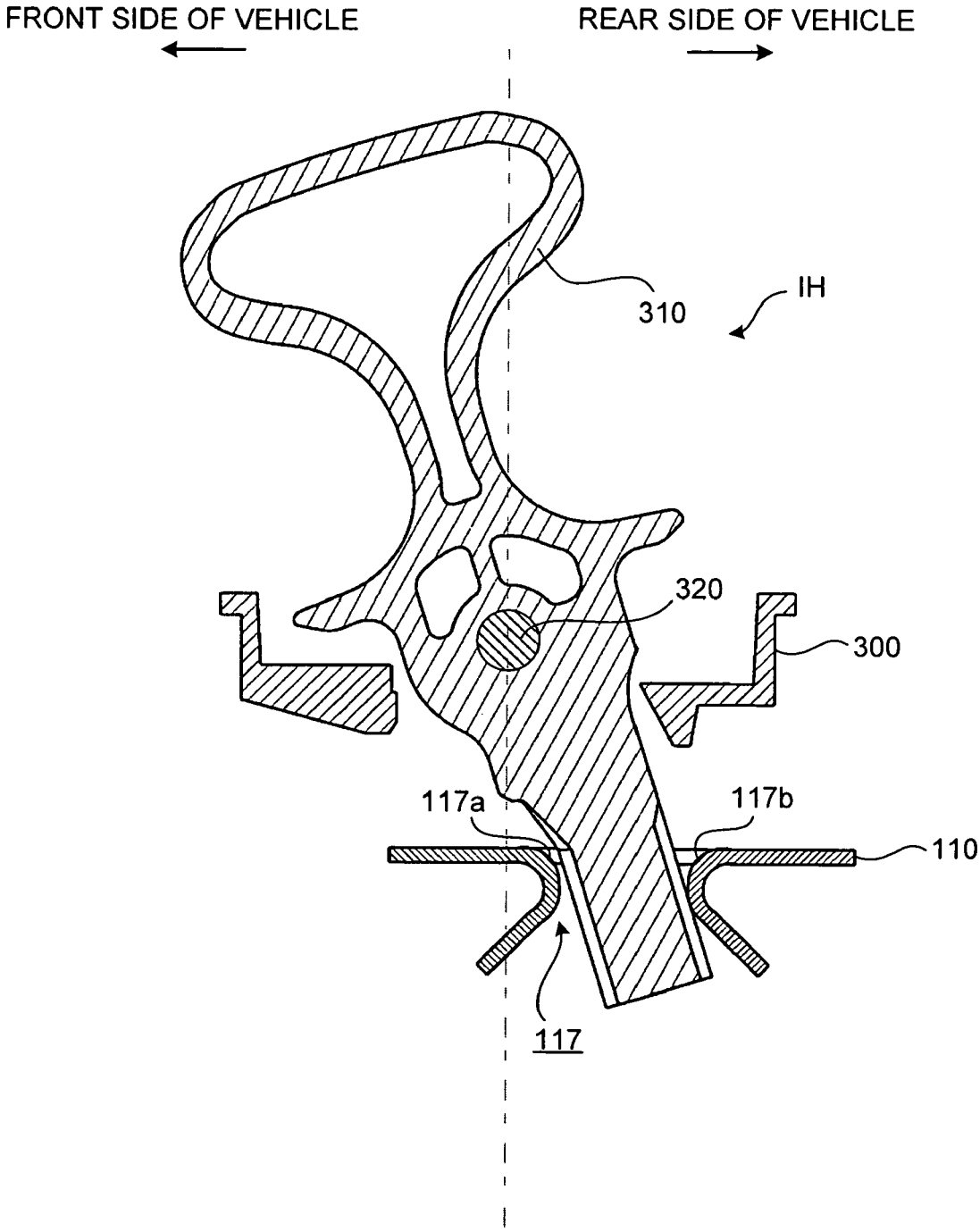
FIG. 17 is a cross section of the inside knob shown in FIG. 15, in a state of closing operation.

On the other hand, as shown in FIGS. 15 to 17, the door operating apparatus is provided with the inside knob IH. The inside knob IH is provided with a knob base member 300 and an operation knob member 310. The knob base member 300 and the operation knob member 310 are coupled to each other via an operation shaft member 320 extending along a longitudinal direction of the knob base member 300, and the operation knob member 310 can be tilted to the knob base member 300 about the operation shaft member 320.

The operation knob member 310 is provided with only an operation output portion 311. The operation output portion 311 extends toward the opposite direction of the operation shaft member 320 from the operation knob member 310, and projects to the back side of the knob base member 300 via a notch provided in the knob base member 300. A cross sectional size of the operation output portion 311 is small enough to insert into the output-portion engagement hole 117 of the door-operating lever 110.

When the inside knob IH is relatively positioned by a positioning unit (not shown) provided between the inside knob IH and the base plate 101, for example, when a positioning pin provided on one of the inside knob IH and the base plate 101 is inserted into a positioning hole provided on the other thereof, a temporary assembled state can be obtained where the operation output portion 311 of the operation knob member 310 has been inserted into the output-portion engagement hole 117 of the door-operating lever 110 via the insertion window hole 101*a* of the base plate 101 in a state that the operation shaft member 320 extends in a vertical direction. When a mounting screw is fastened via a mounting screw insertion hole 300*a* provided in the knob base member 300 and a screw insertion hole 101*f* provided in the base plate 101 from the temporary assembled state, the door operating apparatus can be mounted on the door inner panel IP of the slide door D. In this case, a work for linking the inside knob IH and the door-operating lever 110 to each other is not required, so that a mounting work for the door operating apparatus can be performed easily.

Reference numeral 340 in FIG. 15 denotes a lock knob linked to the locking output lever 191 via a link rod 341. When the lock knob 340 is operated manually, the control unit 100 can be switched between the lock state and the unlock state without requiring actuation of the locking actuator 190.

FIGS. 18 to 26 are schematics of the control unit 100. The control unit 100 is mounted on the door inner panel IP while the operation knob member 310 of the inside knob IH is exposed to an inside of the vehicle. The control unit 100 can be operated appropriately by a vehicle passenger.

Figure 18:
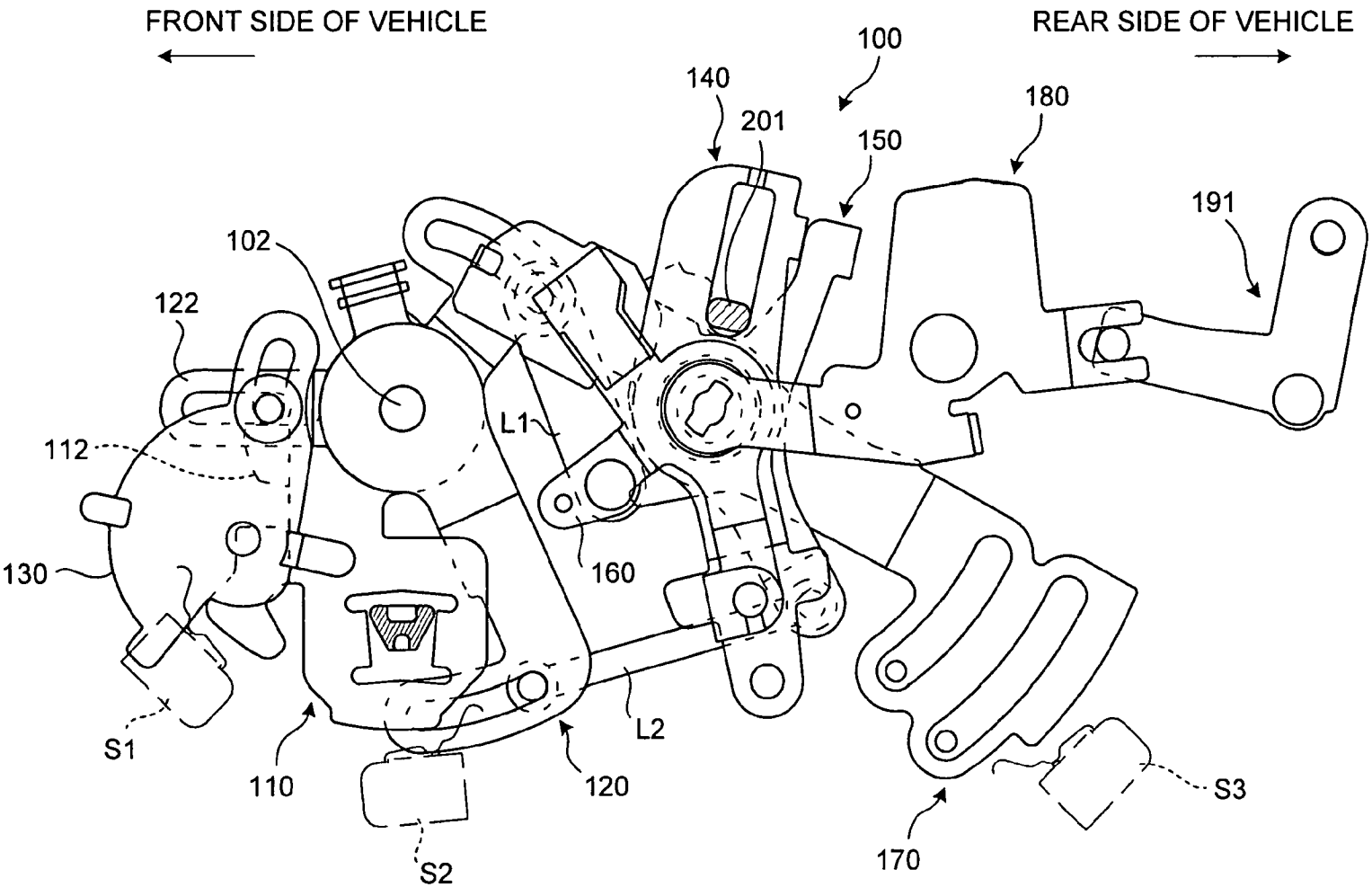
FIG. 18 is a schematic of the control unit shown in FIG. 3, in an initial state.

When the control unit 100 is in an initial state, the operation knob member 310 is positioned at a neutral position, where the operation output portion 311 has been inserted into the output-portion engagement hole 117 of the door-operating lever 110 held in a home position, as shown in FIG. 18. In the initial state shown in FIG. 18, the pin slide portion 122 of the link lever 120 is held in a home position where it extends along the link engagement portion 112 of the door-operating lever 110 by a resilient force of the return coil spring 103. The open sub-lever 150, the open lever 140, and the open knob lever 170 are put in a state that they have been fully rotated counterclockwise in FIG. 17 by a resilient force of the first coil spring 155, and the lower open lever 160 and the open knob lever 170 are put in a state that they have been fully rotated counterclockwise in FIG. 17 by a resilient force of the second coil spring 164. For sake of simplicity, it is assumed that the child lock lever 130 is in the unlock position and the control unit 100 is in the unlock state in the initial state shown in FIG. 18.

Figure 19:
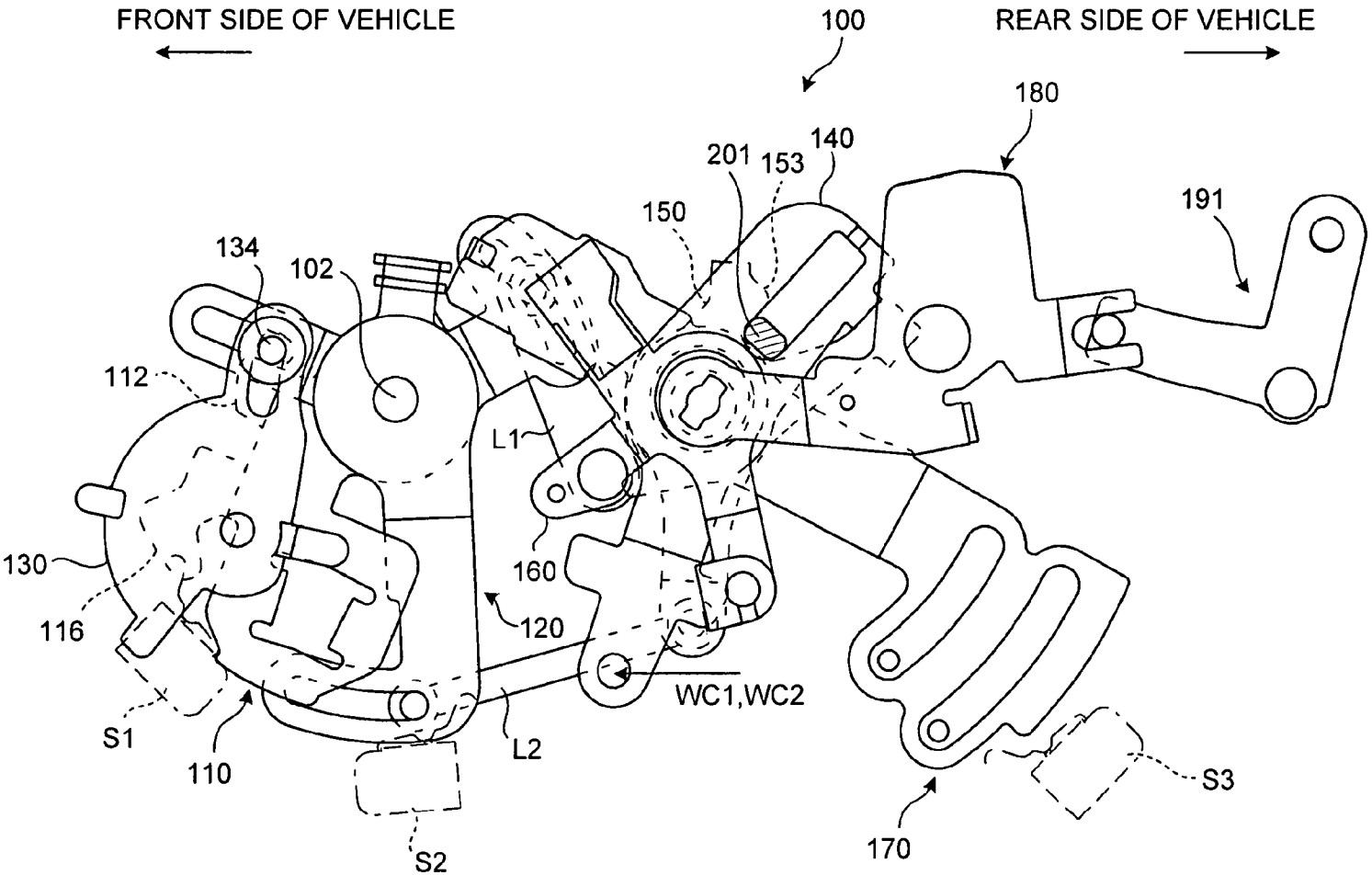
FIG. 19 is a schematic of the control unit shown in FIG. 3, in which the inside knob in an opening operation.
Figure 20:
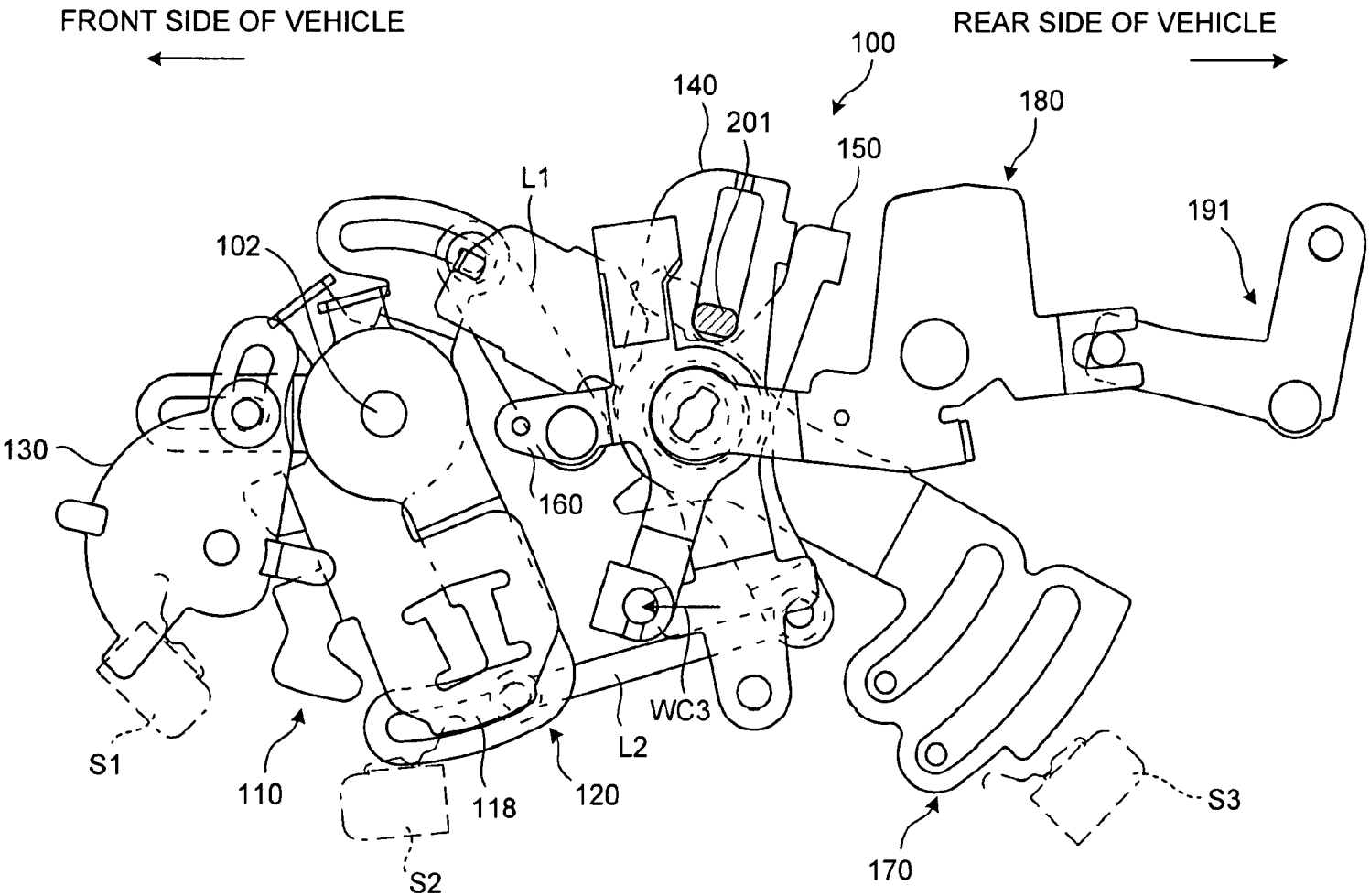
FIG. 20 is a schematic of the control unit shown in FIG. 3, in which the inside knob in a closing operation.

As shown in FIG. 16, when the operation knob member 310 of the inside knob IH is tilted from the initial state toward the rear side of the vehicle (a door opening operation of the inside knob IH), the operation output portion 311 abuts on the front-side abutting face 117*a* of the output-portion engagement hole 117, so that the door-operating lever 110 is rotated clockwise in FIG. 19. According to the clockwise rotation of the door-operating lever 110, the rotation is transmitted to the link lever 120 via the link engagement portion 112 and the engagement pin 134 so that the link lever 120 is rotated clockwise.

According to the rotation of the link lever 120, the open sub-lever 150 is rotated clockwise via the second coupling link L2 and the rotation of the open sub-lever 150 is transmitted to the open lever 140 via the lock-pin engagement portion 153 and the lock pin 201, so that the open lever 140 is rotated clockwise. Therefore, the first wire cable WC1 and the second wire cable WC2 are pulled, respectively.

Since the closed-door latch unit CR performs releasing operation when the first wire cable WC1 is pulled, for example, even if the slide door D is in a closed state, the slide door D can be moved to be opened by tilting the inside knob IH to the rear side of the vehicle.

Since the clutch mechanism in the closure device CL becomes a disconnected state when the second wire cable WC2 is pulled, for example, even if the closure device CL is in an operating state, shift operation from a half latch state to a full latch state can be interrupted by tilting the inside knob IH toward the rear side of the vehicle.

When the door-operating lever 110 is rotated clockwise in FIG. 19, the door-opening-operation detector 116 turns the first door-operation detecting sensor S1 ON. Therefore, the tilting operation of the operation knob member 310 toward the rear side of the vehicle can be detected based on the detection result of the first door-operation detecting sensor S1.

As shown in FIG. 17, when the operation knob member 310 of the inside knob IH is tilted from the initial state toward the front side of the vehicle (a door closing operation of the inside knob IH), the operation output portion 311 abuts on the rear-side abutting face 117*b* of the output-portion engagement hole 117, so that the door-operating lever 110 is rotated counterclockwise in FIG. 19. According to the counterclockwise rotation of the door-operating lever 110, the rotation is transmitted to the lower open lever 160 via the first coupling link L1, so that the lower open lever 160 is rotated clockwise.

The third wire cable WC3 is pulled according to clockwise rotation of the lower open lever 160, so that the opened door latch unit OR performs releasing operation. As a result, for example, even if the slide door D is in the opened state, the slide door D can be moved to be closed by tilting the inside knob IH toward the front side of the vehicle.

Since the door-closing-operation detector 118 turns the second door-operation detecting sensor S2 ON according to counterclockwise rotation of the door-operating lever 110, tilting operation of the operation knob member 310 toward the front side of the vehicle can be detected based on the detection result of the second door-operation detecting sensor S2.

Figure 21:
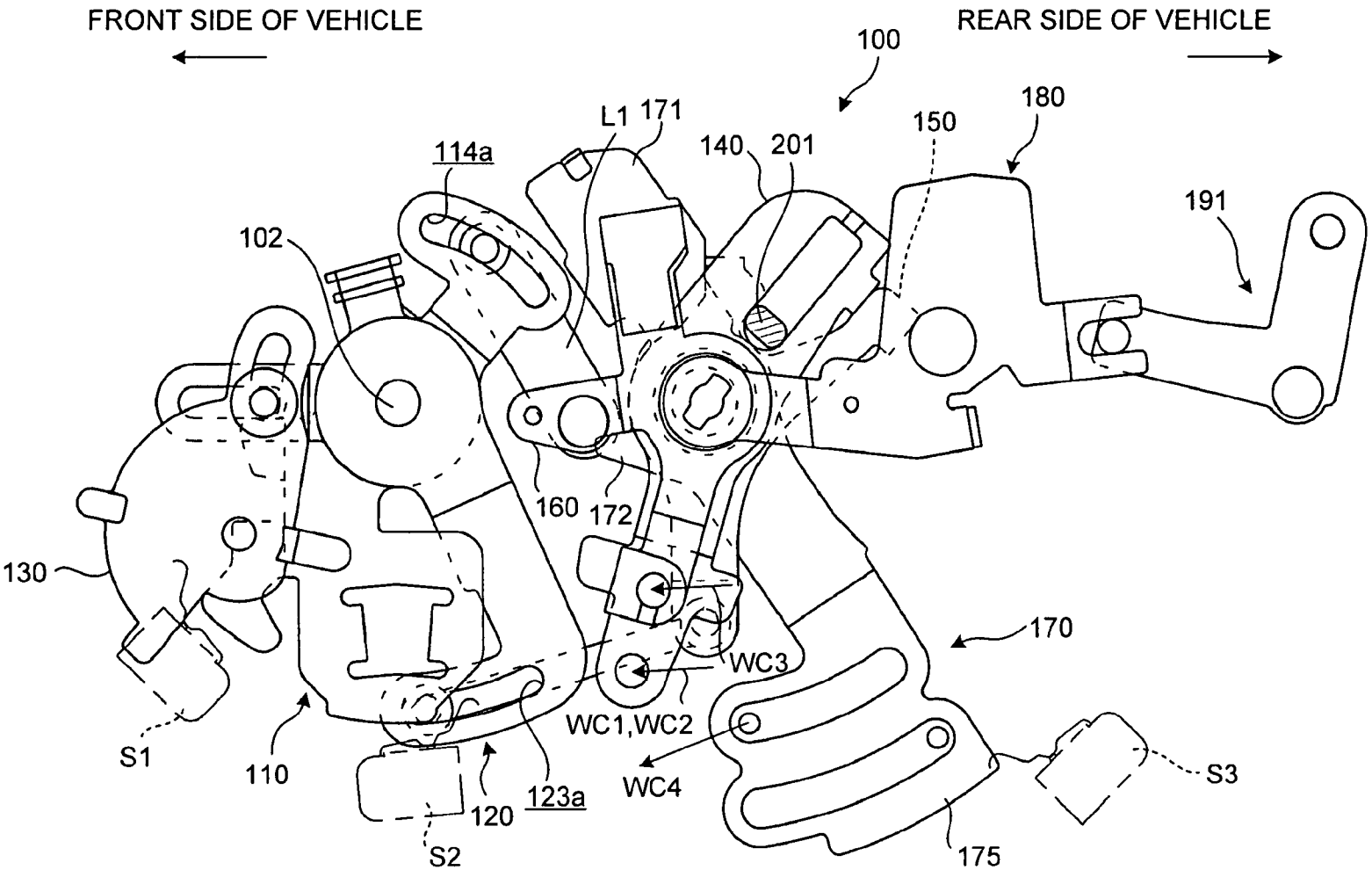
FIG. 21 is a schematic of the control unit shown in FIG. 3, in which an outside knob is operated.

As shown in FIG. 21, when the outside knob OH is operated from its initial state, the open knob lever 170 is rotated clockwise via the fourth wire cable WC4. The rotation of the open knob lever 170 is transmitted to the lower open lever 160 via the first lever engagement portion 172 and is also transmitted to the open sub-lever 150 via the second lever engagement portion 173, which results in clockwise rotations of the lower open lever 160 and the open sub-lever 150.

The third wire cable WC3 is pulled according to the clockwise rotation of the lower open lever 160, so that the opened door latch unit OR performs releasing operation. As a result, for example, even if the slide door D is in an opened state, the slide door D can be moved to be closed by operating the outside knob OH.

On the other hand, according to clockwise rotation of the open sub-lever 150, the rotation is transmitted to the open lever 140 via the lock-pin engagement portion 153 and the lock pin 201, and the first wire cable WC1 and the second wire cable WC2 are pulled according to clockwise rotation of the open lever 140. As a result, for example, even if the slide door D is in a closed state, the slide door D can be moved to be opened by operating the outside knob OH. Further, for example, even if the closure device CL is in an operating state, shift operation from a half latch state to a full latch state can be interrupted by operating the outside knob OH.

In the above operations, since the one end of the first coupling link L1 based upon moves in the first slide groove hole 114*a* of the door-operating lever 110, the door-operating lever 110 does not operate due to clockwise rotation of the lower open lever 160. Similarly, since the one end of the second coupling link L2 properly moves in the second slide groove hole 123*a* of the link lever 120, the link lever 120 does not operate due to clockwise rotation of the open sub-lever 150.

Since the third door operation detector 175 turns ON the third door-operation detecting sensor S3 according to clockwise rotation of the open knob lever 170, it is possible to detect the operation of the outside knob OH based on the detection result of the third door-operation detecting sensor S3.

Figure 22:
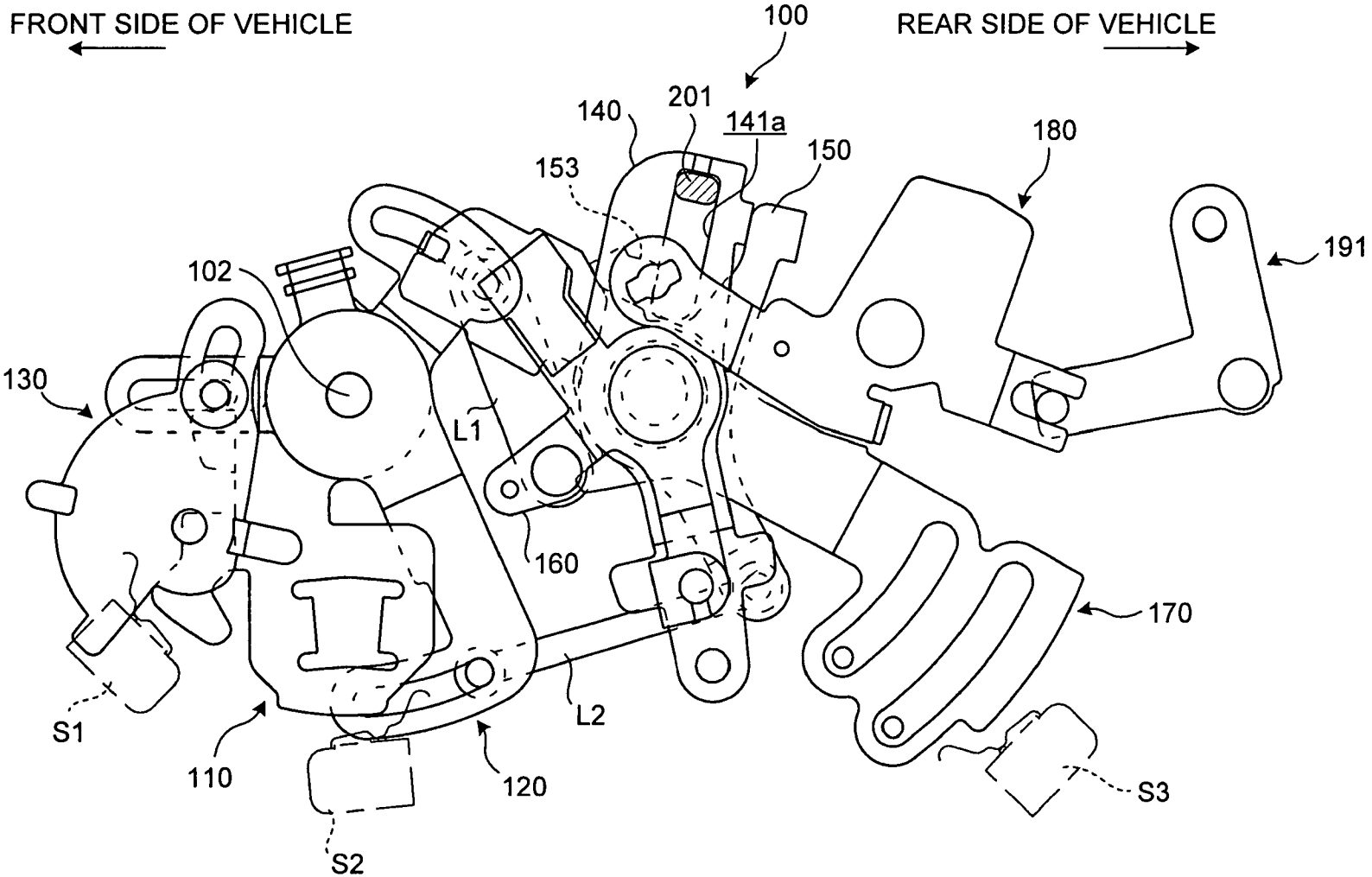
FIG. 22 is a schematic of the control unit shown in FIG. 3 in a lock state.
Figure 23:
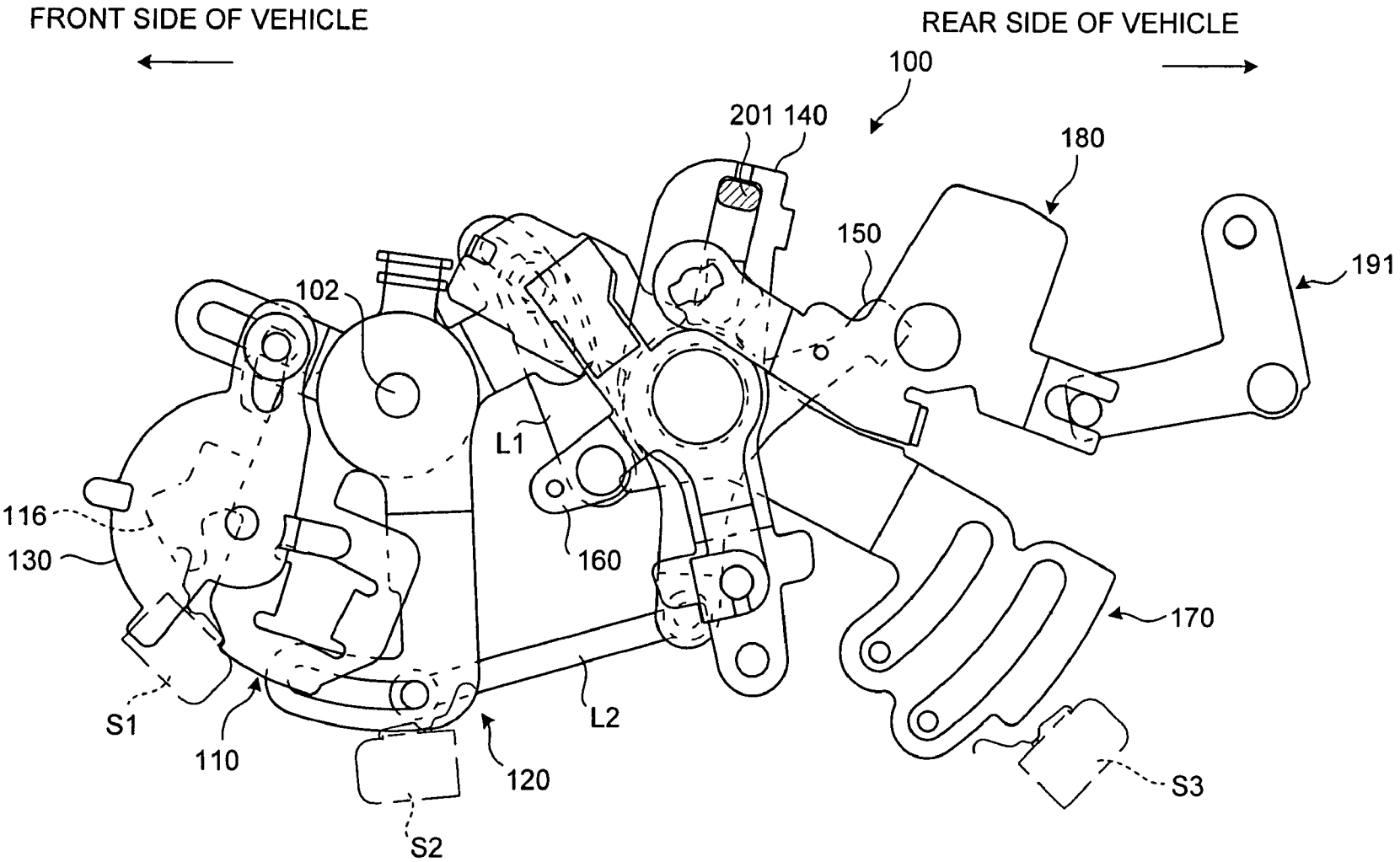
FIG. 23 is a schematic of the control unit shown in FIG. 3, in which the inside knob is in an opening operation while the control unit is in a lock state.

When the control unit 100 is switched from the initial state to the lock state, as shown in FIG. 22, the lock pin 201 in the lock-pin slide groove 141*a* of the open lever 140 is positioned out of the rotational movement region of the lock-pin engagement portion 153. Accordingly, when the inside knob IH is tilted from the lock state toward the rear side of the vehicle, as shown in FIG. 23, clockwise rotation of the door-operating lever 110 is transmitted to the open sub-lever 150 via the link lever 120 and the second coupling link L2, but rotation of the open sub-lever 150 is not transmitted to the open lever 140. As a result, since the closed-door latch unit CR is not caused to perform releasing operation, for example, when the slide door D is in a closed state, the slide door D can not be moved to be opened. However, since the door-opening-operation detector 116 turns the first door-operation detecting sensor ON S1 according to rotation of the door-operating lever 110 even in the lock state, it is possible to detect the tilting operation of the inside knob IH toward the rear side of the vehicle based on the detection result of the first door-operation detecting sensor S1.

Figure 24:
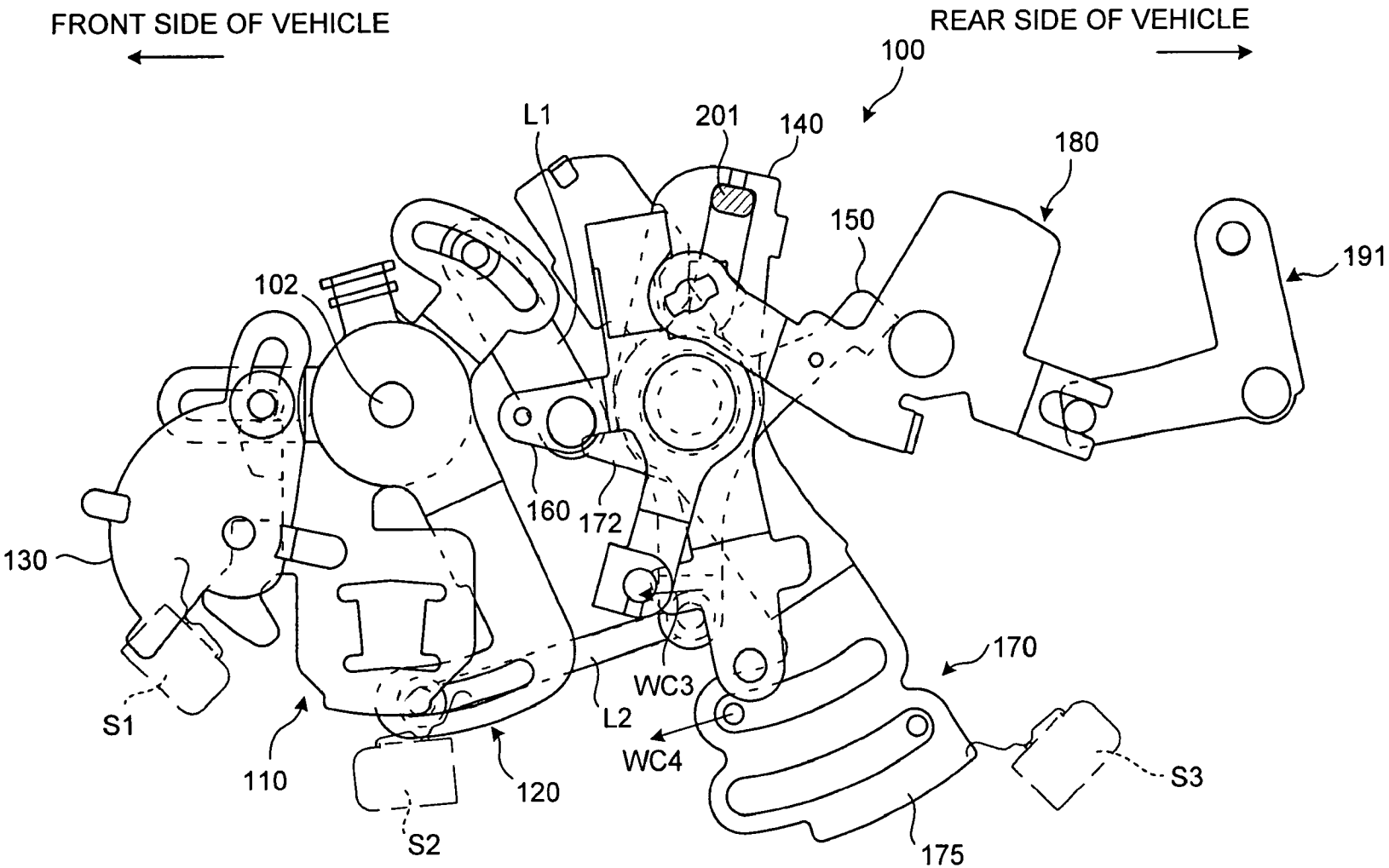
FIG. 24 is a schematic of the control unit shown in FIG. 3, in which the outside knob is operated while the control unit is in the lock state.
Figure 25:
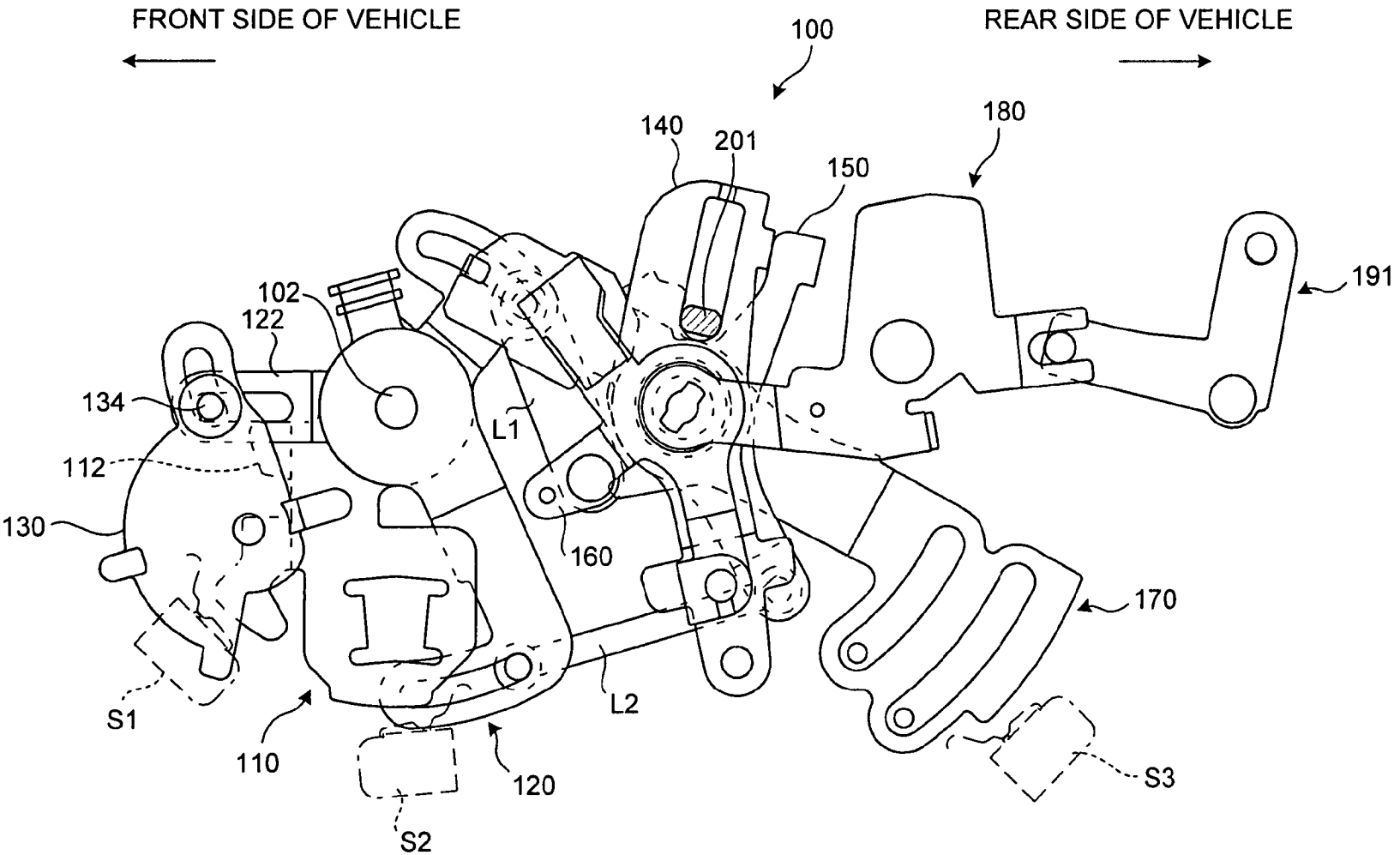
FIG. 25 is a schematic of the control unit shown in FIG. 3, in a child-lock state.
Figure 26:
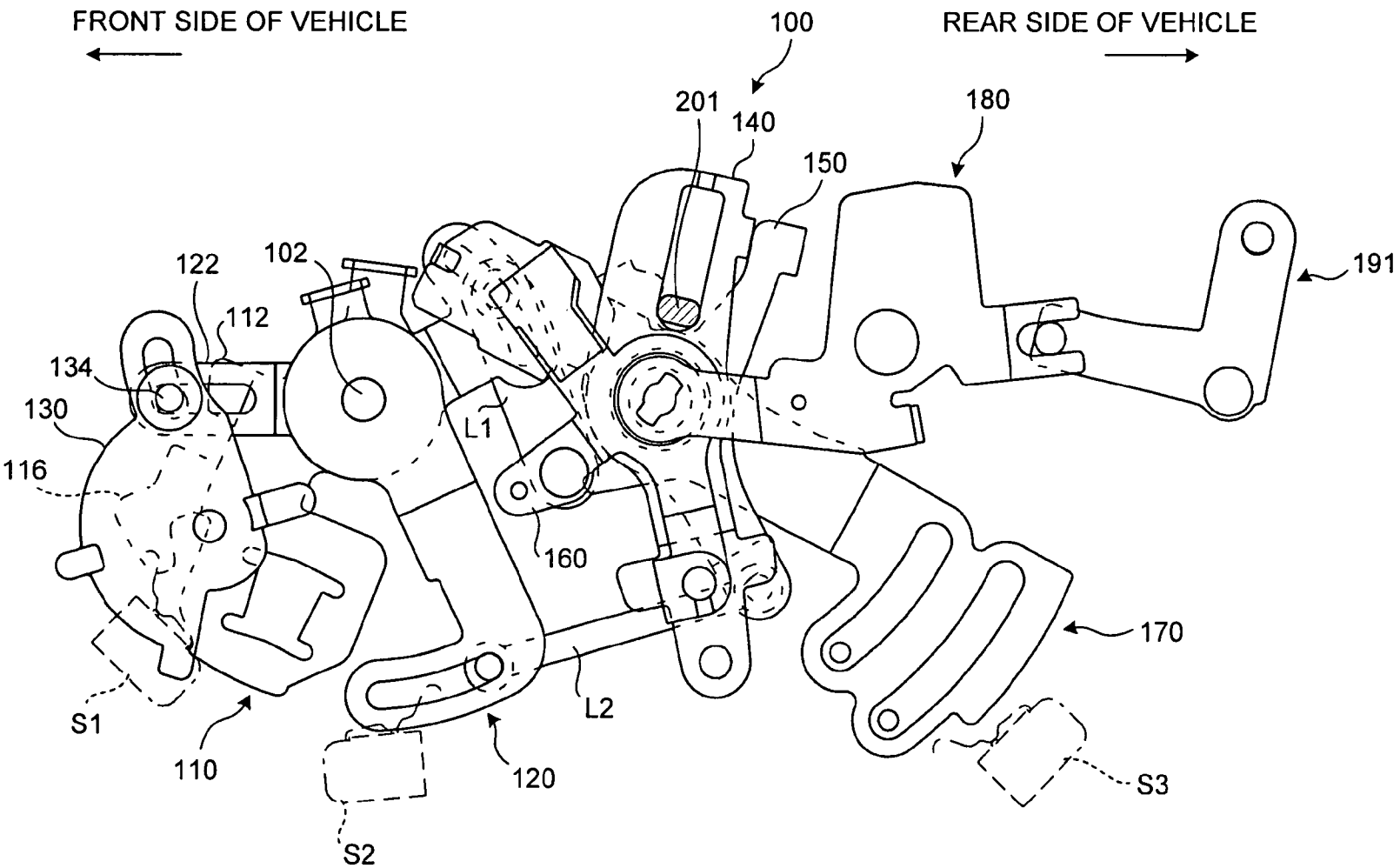
FIG. 26 is a schematic of the control unit shown in FIG. 3, in which the inside knob is in an opening operation while the control unit is in the child-lock state.

When the outside knob OH is operated from the lock state shown in FIG. 22, as shown in FIG. 24, rotation of the open sub-lever 150 according to rotation of the open knob lever 170 is not transmitted to the open lever 140. As a result, since the closed-door latch unit CR is not caused to perform releasing operation, for example, when the slide door D is in a closed state, the slide door D can not be moved to be opened. However, since rotation of the open knob lever 170 is transmitted to the lower open lever 160 via the first lever engagement portion 172 even in the lock state so that the third wire cable WC3 is pulled, for example, when the slide door D is in an opened state, the slide door D can be moved to be closed by operating the outside knob OH. Since the third door operation detector 175 turns ON the third door-operation detecting sensor S3 according to rotation of the open knob lever 170 even in the lock state, it is possible to detect the operation of the outside knob OH based on the detection result of the third door-operation detecting sensor S3.

On the other hand, when the child lock lever 130 is switched from an initial state thereof to a lock position, as shown in FIG. 16, the engagement pin 134 in the pin slide portion 122 of the link lever 120 is positioned out of the rotational movement region of the link engagement portion 112 in the door-operating lever 110. Accordingly, even if the inside knob IH is tilted from this state toward the rear side of the vehicle, as shown in FIG. 17, rotation of the door-operating lever 110 is not transmitted to the link lever 120, that is, the link engagement portion 112 does not abut on the engagement pin 134. Therefore, the link lever 120 is not rotated and the closed-door latch unit CR is not caused to perform releasing operation. However, when the control unit 100 is in the unlock state, the lower open lever 160 and the open sub-lever 150 are respectively rotated clockwise by operating the outside knob OH even in this state. Therefore, the slide door D can be opened and closed. Since the door-opening-operation detector 116 turns the first door-operation detecting sensor S1 ON according to rotation of the door-operating lever 110, it is possible to detect the tilting operation of the inside knob IH toward the rear side of the vehicle based on the detection result of the first door-operation detecting sensor S1.

As explained above, in the door operating apparatus according to the present invention, the operation output portion 311 formed on the inside knob IH is directly abutted on the door-operating lever 110 so that a force generated between the inside knob IH and the door-operating lever 110 is transmitted. Therefore, work for linking the inside knob IH and the door-operating lever 110 to each other becomes unnecessary, which facilitates an assembling work. Further, since the opened door latch unit OR and the closed-door latch unit CR are selectively operated for releasing by utilizing one door-operating lever 110, it is possible to facilitate an assembling work owing to reduction in the number of parts to be handled.

According to the present invention, a work for linking the inside knob and the door-operating lever becomes unnecessary, and an assembling work becomes easy. In addition, facilitation of an assembling work owing to reduction in the number of parts to be handled can be achieved.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2004-342868, filed Nov. 26, 2004, which is incorporated herein by reference in its entirety.

What is claimed is:

1. An apparatus for opening and closing a door of a vehicle, the apparatus comprising:

a door-operating knob that is operated to open or close the door;

a closed-door holding unit configured to hold the door in a closed state, and to release the door in response to an opening operation of the door-operating knob to allow an opening of the door with respect to a body of the vehicle;

an opened-door holding unit configured to hold the door in an opened state, and to release the door in response to a closing operation of the door-operating knob to allow a closing of the door with respect to the body of the vehicle; and a control unit that controls operations of the closed-door holding unit and the opened-door holding unit, the control unit including:

a base plate; and a door-operating lever configured to cause the closed-door holding unit to release the door by rotating in one direction, and to cause the opened-door holding unit to release the door by rotating in another direction, wherein:

the door-operating lever is disposed on the base plate and provided with an output-portion engagement hole, the door-operating knob is pivotally attached to a knob base member via an operation shaft member and includes an operation output portion that engages with the door-operating lever, the operation output portion protrudes from the door-operating knob toward an opposite direction of the operation shaft member through a notch provided in the knob base member and through the output-portion engagement hole of the door-operating lever, when the door-operating knob is operated to open or close the door, the operation output portion makes a contact with the door-operating lever to be engaged in such a manner that the door-operating lever is rotated in either of the directions;

the control unit is attached on a side of a door inner panel facing an inside of the vehicle, and the door-operating knob is disposed such that the door-operating knob overlaps the door-operating lever in a width direction of the vehicle.

2. The apparatus according to claim 1, wherein the door-operating knob is an inside door knob.

3. The apparatus according to claim 1, wherein the door-operating knob is an outside door knob.

4. The apparatus according to claim 1, wherein the door-operating lever is configured to rotate about a knob lever shaft.

5. The apparatus according to claim 1, wherein the inside knob contacts the door-operating lever.

* * * * *